US008820577B2

(12) United States Patent
Rusch et al.

(10) Patent No.: US 8,820,577 B2
(45) Date of Patent: Sep. 2, 2014

(54) DEVICE FOR DISPENSING A LIQUID

(75) Inventors: Christoph Rusch, Biel (CH); Elmar Mock, Colombier (CH); Gary Cooper, Meinisberg (CH); Andre Klopfenstein, La Neuveville (CH); Naomi Bitmead, Niederwangen B. Bern (CH); James Peter Herrick, Dublin, OH (US); Amol Ashok Bhalerao, Dublin, OH (US); Randall L. Morrison, Marysville, OH (US); Bernard Guillemain, Lausanne (CH)

(73) Assignee: Nestec S.A., Vevey (CH)

( * ) Notice: Subject to any disclaimer, the term of this patent is extended or adjusted under 35 U.S.C. 154(b) by 1120 days.

(21) Appl. No.: 12/669,737

(22) PCT Filed: Jul. 8, 2008

(86) PCT No.: PCT/EP2008/058827

§ 371 (c)(1),
(2), (4) Date: Jan. 19, 2010

(87) PCT Pub. No.: WO2009/010418

PCT Pub. Date: Jan. 22, 2009

(65) Prior Publication Data

US 2010/0193544 A1 Aug. 5, 2010

(30) Foreign Application Priority Data

Jul. 19, 2007 (EP) ..... 07014191

(51) Int. Cl.
*B67D 1/00* (2006.01)

(52) U.S. Cl.
USPC ..... 222/82; 222/83; 222/129.1; 222/185.1; 222/325; 222/333; 222/481.5

(58) Field of Classification Search
USPC ..... 222/80–84, 129.1, 185.1, 325, 333, 222/363, 368, 370, 427, 428, 165, 481.5, 222/181.1
See application file for complete search history.

(56) References Cited

U.S. PATENT DOCUMENTS

| | | | | |
|---|---|---|---|---|
| 3,685,964 | A * | 8/1972 | Iarelli | 423/158 |
| 3,750,908 | A * | 8/1973 | Bauerlein et al. | 222/80 |
| 4,972,971 | A * | 11/1990 | Janko et al. | 222/5 |
| 5,791,526 | A * | 8/1998 | Landais et al. | 222/185.1 |
| 6,971,549 | B2 * | 12/2005 | Leifheit et al. | 222/83 |
| 8,544,692 | B2 * | 10/2013 | Rusch et al. | 222/153.06 |
| 2003/0000964 | A1 | 1/2003 | Schroeder et al. | |

FOREIGN PATENT DOCUMENTS

| | | |
|---|---|---|
| NL | 1017859 | 10/2002 |
| WO | 2006005401 | 1/2006 |

OTHER PUBLICATIONS

International Search Report dated Jan. 5, 2009, 3 pages.
Written Opinion of the International Searching Authority dated Jan. 5, 2009, 6 pages.

* cited by examiner

*Primary Examiner* — Frederick C Nicolas
(74) *Attorney, Agent, or Firm* — K&L Gates LLP

(57) ABSTRACT

A device for dispensing a liquid is connectable to a container containing the liquid and detachably connectable to a base station having a drive member, the device including a liquid duct and a pump actuated by the drive member for effecting passage of liquid through the duct, characterized in that the device includes a cutter for piercing a tamper resistant foil positioned across the outlet of the container and that a push pin for actuating the cutter is operable from outside the device.

24 Claims, 30 Drawing Sheets

DEVICE FOR DISPENSING A LIQUID

BACKGROUND OF THE INVENTION

The present invention relates to a device and system for dispensing a liquid. More particularly, the invention relates to the preparation and delivery of drinks, or other liquid food products, by metering a food liquid and optionally mixing this food liquid with a diluent. The invention finds an application in the delivery of drinks, with or without froth, hot or cold, from a liquid concentrate and water, hygienically, easily and quickly, even when the volumes delivered are large.

In conventional drinks dispensers, the drinks are reconstituted from a liquid concentrate or powder contained in reservoirs. The liquid concentrate or the powder is metered then mixed with a diluent, generally hot or cold water, inside the dispenser, passing through pipes, pumps and mixing bowls. Mixing is generally performed by a mechanical stirrer contained within a chamber. The conventional preparation of these drinks therefore requires a great deal of maintenance and cleaning in order to keep those parts that are in contact with the food product constantly clean and avoid the risks of contamination and bacterial growth. The machines also represent a significant investment on the part of the operators. Finally, these machines lack versatility in terms of the choice of drinks delivered, even though the current trend is to extend the choice of hot, cold, frothy or non-frothy drinks.

WO-A-2006/005401 describes a device for metering a base liquid and mixing this base liquid with a diluent to prepare a food product, the device being able to be connected to a container containing the liquid, and the device comprising a liquid pump configured to meter a quantity of liquid through a liquid metering duct, a diluent inlet with a diluent duct, and a mixing chamber for mixing the liquid with the diluent, wherein: the diluent duct is positioned relatively to the liquid metering duct so that the diluent stream intersects the liquid stream before or at the mixing chamber. In a preferred configuration, the metering device is in the form of a cap which is connected to the container by appropriate connecting means. The device of WO-A-2006/005401 provides an improved solution for metering then correctly mixing a liquid with a diluent. Through the inherent speed of the diluent and the meeting of the ducts the shearing of the fluids and the mixing of the fluids in the mixing chamber are improved.

Although the device of WO-A-2006/005401 enables a compact drinks dispensing system which is simpler to keep hygienic compared to previous systems, there can be some risk of spillage or leakage, with consequent hygiene problems, during attachment of the cap device to the container of liquid. Any protective cover or film on the container has to be removed before the cap device is attached to the container.

BRIEF SUMMARY OF THE INVENTION

The present invention concerns a device for dispensing a liquid, the device being connectable to a container containing the liquid and detachably connectable to a base station for docking the device and having drive means, the device comprising a liquid duct and a liquid pump actuated by the base station drive means for effecting passage of liquid through the duct, wherein the device comprises a cutter for piercing a tamper resistant foil positioned across the outlet of the container and means for actuating the cutter are operable from outside the device.

Preferably, the means for actuating the cutter are configured to be operable from outside the device by drive means which form part of the base station when the device is connected to base station, although the cutter could also be actuated manually by a user to effect the perforation of the foil before the device is connected to the base station.

The invention includes a package for dispensing a liquid, comprising a multi-dose container to form a reserve of liquid and a dispensing device as defined above which forms a cap connected to the container. The invention also includes apparatus for dispensing a liquid comprising such a package docked in a base station having drive means which are detachably connected to the means for actuating the cutter of the dispensing device.

The device of the invention can be assembled on the container of liquid without breaking the tamper resistant foil protecting the liquid. The foil need not be breached until the container and dispensing device, now firmly connected to each other, are connected to the base station.

The cutter can for example comprise a blade and the actuating means can comprise a push pin urging the blade through the foil. It may be preferred that the blade and actuating means are non-retractable so that when the blade has perforated the foil it remains protruding through the foil. To avoid the possibility of cross-contamination of liquids, it may be preferred that the dispensing device, once attached as a cap to the container, remains on the same container until it is discarded when the container is empty. If the cap is connected to the container by screw thread a ratchet system between the container neck and the cap thread may inhibit the removal of the cap from the container.

When piercing the foil, it is preferred to have a tear line which is as short as possible to avoid any problem from loose foil becoming detached and contaminating the liquid dispensed or blocking the liquid duct. However, it is also preferred that the cutter has a shape allowing maximum throughput of liquid. We have found that these conflicting objectives can best be achieved by a blade having a V-shaped cutting edge so as to form a V-shaped perforation in the foil. The cutter blade can for example be substantially planar with a peak portion including the V-shaped cutting edge being raised upwards from the flat portion of the blade. To maximize throughput of liquid and to allow air to enter the liquid container, the cutter blade may have an aperture or cutaway portion behind the cutting edge. For example, the rear portion of the blade may have a V-shaped cutaway portion substantially parallel to the V-shaped cutting edge.

In a preferred form of device, the cutter is mounted to rotate about an axis and comprises a lever portion integral with the blade and on the other side of the axis from the cutting edge so that the actuating means, for example a push pin, can act against the lever portion of the blade by a lever mechanism to urge the cutting edge of the blade through the foil. The cutter is preferably made of hard plastics material, although metal is an alternative.

In a preferred embodiment, the dispensing device of the invention acts as a device for metering the liquid dispensed. Such a device may comprise a liquid pump which measures aliquots of liquid through the liquid duct. The pump may be any pump capable of transporting a liquid in a wide range of viscosities, particularly between 1 and 5000 centipoise. It may be a gear pump, a peristaltic pump or, alternatively, a piston pump.

The dispensing device according to the invention is intended to be controlled by means of a base station with which the dispensing device is docked in a complementary manner. Thus, coupling means are provided and configured in such a way as to connect the dispensing device to the base station, which is itself capable of providing the drive means for actuating the cutter and driving the liquid pump. Drive means can be any known mechanism by which force is transmitted in and through the base station. Dissociating the dispensing device from the function of driving the pump has the advantage that the dispensing device can be interchanged as often as necessary, for example it may be replaced by a new device which is assembled with a new container. Such replacement makes it possible to avoid, or at the very least considerably reduce, the need for maintenance and cleaning of the metering and mixing device. That also allows greater flexibility in the operation of a drinks dispensing machine, by interchanging the dispensing devices while at the same time keeping a common base station.

In a preferred embodiment, the pump is a pump of the gear type. Such a pump comprises a chamber in which a series of rotary elements which collaborate in the manner of gearing is housed. The pump comprises an inlet passage for letting the liquid into the pump chamber and a liquid outlet passage connecting the pump chamber to the liquid metering duct, the liquid inlet and outlet passages being more or less in alignment with the gearing formed by the series of rotary elements. A gear pump in the context of the invention provides a more uniform flow of metered liquid, better precision on the amount of liquid metered and a more compact construction involving a relatively limited number of moving parts. The rotary elements are thus preferably two in number, although the number of pairs of elements is not a limitation in itself. For preference, a first rotary element is extended by a coupling means intended to be connected to a complementary coupling means associated with drive means belonging to the base station. As is known per se, the rotary element comprising the coupling means is usually termed the "master" element while the other rotary element is usually termed the "slave" element.

The dispensing device is preferably capable of mixing the liquid from the container with a diluent to provide a food or drink product. The dispensing device preferably comprises a diluent inlet with a diluent duct, and a mixing chamber for mixing the liquid with the diluent as described in WO-A-2006/005401. The diluent duct is positioned relatively to the liquid metering duct so that the diluent stream intersects the liquid stream before or at the mixing chamber.

In one possible mode, a non-return valve is positioned in the liquid duct to prevent any potential dripping from the pump at the intersection and in the mixing chamber. Indeed, although a gear pump provides a seal function, it is not possible to assure a total liquid tightness with the pump only during the rest period of the device, especially, when low viscosity concentrates are used.

As one of the objects of the invention is to limit any possible interaction between the product and part of the machine, the dispensing device comprises its own outlet duct for delivering the flow of food liquid, optionally diluted and mixed, directly downstream of the mixing chamber into a receptacle. A receptacle is to be understood as meaning, for example, a glass, a bowl or a mug or any other receptacle to serve to the consumer.

In a preferred configuration, the dispensing device of the invention is in the form of a cap which is connected to the container by appropriate connecting means. In particular, the dispensing device can comprise two half-shells assembled along a parting line passing through the pump and the outlet duct. The construction in the form of a cap with two half-shells offers the advantage of requiring fewer assembly-parts and also of being more compact by comparison with the known constructions that usually incorporate pumping and mixing means.

The dispensing device, in this configuration as two half-shells is preferably made of plastic, such as an injected or moulded plastic. The device may thus be used for a limited number of dispensing, metering and mixing operations then disposed of or recycled.

In a preferred embodiment, the dispensing device is associated with a container which, together with the dispensing device, forms a package that may be disposable or recyclable. The container may be a non-collapsible or a collapsible member. It may be, for instance, a bottle, a brick, a pouch, a sachet or the like. It may be made of plastic, cardboard, paper, aluminium or a mixture and/or laminate of these materials. The container and the device may be connected by permanent or detachable means. Permanent means may be designed to be sealing, welding, bonding, non-reversible clipping means, etc means. Detachable means may mean an assembly formed of a threaded portion or equivalent complementary mechanical engagement means on the cap forming the metering device which collaborates with a threaded portion or complementary mechanical engagement means belonging to the container.

The liquid duct leads, optionally via a mixing chamber, from the container to an outlet which may for example be in the form of a dispensing nozzle. The dispensing device preferably comprises an outer cover closing the outlet of the liquid duct. The cover is arranged to be openable so that the outlet is opened when the device is connected to the base station, and reclosable so that the outer cover can close the outlet when the dispensing device is disconnected from the base station. In use, the container with the dispensing device attached to it, can be changed for dispensing different flavours. The outer cover protects the dispensing nozzle or other outlet of the device from dirt, insects etc. when the device is not in use in the machine.

The outer cover is preferably arranged so that when the cover is opened to open the liquid outlet, the cover remains attached to the device. The cover can for example comprise a fixed portion and a movable portion joined by a hinge. The fixed portion is attached to the device. The movable portion is movable between a position which closes the outlet and a position which opens the outlet.

If the dispensing device comprises two half-shells assembled along a parting line, the fixed portion of the cover is preferably attached to one of the half-shells. The half-shells may be arranged so that they define, along their parting line, the liquid outlet duct. The fixed portion of the cover can for example have hooks which fit in holes in the shell of the dispensing device, specifically in holes in one half-shell of the device. Alternatively the device can have hooks which fit in holes in the fixed portion of the outer cover. In another alternative, the fixed portion of the outer cover can advantageously be welded to one shell of the dispensing device.

The outer cover is preferably made of hard plastics material, and conveniently is injection molded from the same plastics material as is used to mould the half-shells of the dispensing device. The hinge between the fixed and movable portions of the cover can be a linear section of plastics material thinner than the fixed portion and movable portion.

The fixed portion of the outer cover can in one embodiment comprise a body portion attached to the dispensing device at the upper end nearer the liquid container and remote from the liquid outlet, and side portions positioned below the hinge and to either side of the movable portion. In this embodiment the hinge extends only part way across the cover, and the side portions of the fixed part of the cover are separated by vertically extending slits from a central portion of the movable part of the cover adjacent the hinge. This central portion of the movable part of the cover can be attached to side pieces arranged below the side portions of the fixed part of the cover. The side pieces of the movable portion of the cover can thereby be adapted to be engaged by opening means operated by drive means of the base station, so that the cover can be opened by the base station when it is correctly positioned in the base station.

The movable portion of the outer cover can be a snap fit on the lower portion of the dispensing device in a position which closes the liquid outlet. The movable portion of the cover may have a raised section on its inner surface which forms a support on which the edge of the dispensing nozzle or other liquid outlet duct can rest when the outer cover is closed.

In an advantageous variant, the fixed portion and movable portion of the outer cover can be attached by a tamper evident seal before the dispensing device has been used. Such a seal, which can be a breakable bridge of material arranged between the movable portion of the outer cover and the fixed portion of the outer cover, is adapted to be broken when the device is connected to the base station.

In another variant, a transportation cap fitted onto the dispensing device on top of the outer cover can also be provided. The transportation cap is preferably sealed, for example via a tamper evident neck bander or the like, onto the dispensing device in order to provide visible evidence of seal disruption before the first use. The transportation cap improves, handling, and stackability of containers fitted with the dispensing device. The transportation cap also further improves the protection of the dispensing device from dirt, insects etc. when the container fitted with the dispensing device has been removed temporarily from the machine while not being empty.

The base station on which a dispensing device or a package as described above is intended to be docked generally comprises diluent supply means and drive means which are detachably connected to the means, for example liquid pump drive means, for effecting passage of liquid through the dispensing device and to the means for actuating the cutter of the dispensing device. The base station also comprises an interface area comprising coupling means complementing the coupling means belonging to the device, which are configured to receive the metering and mixing device in a predetermined position and which comprise diluent coupling means and means for coupling the drive for the pump and for the cutter, and control means for controlling the supply of diluent and driving the liquid pump.

More precisely, the diluent supply means comprise a water supply duct connected to a water pump and to a system for controlling the temperature of the water. The temperature control system may be a heating system such as a thermobloc, a heater cartridge, a boiler or any other equivalent means. The control system may also be a refrigeration system able to produce refrigerated drinks or desserts. The drive means may comprise an electric motor and a drive shaft connected to the complementary coupling means to link with the coupling means of the liquid pump. The coupling means may be formed of a mechanical push-together connection of the male-female type, a magnetized mechanism, a screw-fastening system or bayonet system, or any other equivalent means.

The dispensing device fits in a simple and quick way in docking means of the base station. For that, the coupling means of the dispensing device preferably lie on the same side so as to allow the coupling to be readily connected to the docking means of the base station itself comprising complementary coupling means. The dispensing device can be manually plugged into such a docking means. The user can easily perform the docking operation by hand in a simple movement by taking hold of the mixing and metering device, on which the container is preferably mounted, and fitting it in a holder of the docking means of the base station via the dispensing device. More specifically, the coupling means also comprise guide means for translational guidance, in at least one direction that encourages plugging-in or docking, of the metering device with complementary guide means on the docking means of the base station when the dispensing device is fitted in the holder. Means for securing the metering device in the docked position may be provided. The interface area may be protected by protective means such as a cover or the like, but this is not indispensable. By contrast, part of this area may be left visible to allow better interactivity with the user and thus make interchanging the packages easier.

More precisely, the base station includes means for supporting the liquid container and the dispensing device comprising the holder positioned at a fixed distance from the drive means of the base station, with the coupling means of the base station being movable towards the holder to connect to the coupling means of the dispensing device and away from the holder after disconnecting from the dispensing device. This has the advantage of minimizing movement of the dispensing device and of the liquid container, which can be heavy. Larger liquid containers can be used in a system which minimizes movement of the container.

The coupling means of the base station can for example be supported by a drawer drivable by motorized or manual drive means which are able to move said drawer towards and away from the fixed holder. The drawer may be arranged to move between guide rails. The coupling means for the pump can comprise an extensible drive shaft connected to an electric motor, for example having a telescopic construction for driving the pump in rotation. The drive shaft, passes through the drawer, but is not in a driving relationship with the drawer. The drawer can be joined to the motorized or manual drive means by a joint mechanism to allow movement towards and away from the pump drive means, for example a knee joint mechanism. Such a joint mechanism can comprise a drive shaft, driven by the drive means, perpendicular to the direction of movement of the drawer. The drawer can alternatively be driven by a piston connected to the drive means.

The holder for the dispensing device which is positioned on the base station at a fixed distance from the drive means has one or more apertures for the coupling means of the base station and for the diluent supply. The holder may have separate apertures for the coupling means and for the diluent supply. Alternatively the holder can be formed with an opening large enough to accommodate the coupling means, the diluent supply and its control means, and an air supply and its control means if present.

A base station for use with a dispensing device having an outer cover closing the outlet of its liquid duct generally has opening means which engage with the cover or an openable flap thereof. The opening means can be arranged merely to dislodge the cover from its closed position after which it can be moved manually, but are preferably movable by the drive means of the base station, advantageously the drawer drive means, to open the cover, thus opening the liquid outlet as the coupling means of the base station are connected to the dispensing device. A base station for use with a dispensing device having an outer cover preferably also has a closure member to urge the outer cover against the dispensing device to close the liquid outlet after dispensing has taken place and before the dispensing device and container are removed from the holder of the base station. The closure member is preferably movable by the drive means of the base station, advantageously the drawer drive means.

The dispensing device according to the invention may also comprise a code that can be read by a reader associated with the base station. The code comprises information referring to the identity and/or the nature of the product and/or to parameters concerned with the activation of the diluent supply and/or liquid pump drive means. The code may, for example, be used to manage the flow rate of the liquid pump and/or of the diluent pump, contained in the base station, so as to control the liquid:diluent ratio. Other uses of the code are possible, such as checking the authenticity of the product contained in the container or alternatively adjusting the means to alter the temperature of the diluent.

The base station comprises a controller associated with the control means and programmed to control and coordinate the activation of the liquid pump drive means and the activation of the diluent supply means. When the metering and mixing device or the packaging comprises a code, the controller is associated with a reader capable of reading this code and processing the information read.

The dispensing device of the invention has the advantages stemming from a simple and inexpensive structure suited to use over a limited period of time or that can be recycled. The device can adopt the form of a cap associated with the container as a closure. More specifically, the cap can comprise two half-shells assembled with one another along a substantially longitudinal parting line and configured to delimit at least the contours of the chamber of the pump and the mixing chamber. In other words, the two parts are assembled longitudinally along a parting line running in the direction in which the fluids are transported, in particular in the direction in which the liquid and the mixture consisting of the liquid and the diluent are transported.

One half-shell of the cap device can comprise a recess which accommodates the cutter blade in a position in which it does not pierce the tamper resistant foil, with the other half-shell comprising the means for actuating the cutter, for example a push pin. The recess can be formed with opposed laterally extending cylindrical recesses capable of forming a bearing surface. A flat portion of the cutter blade can be formed with outwardly projecting journals fitting into the bearing surface, the journals thereby defining an axis about which the cutter blade can rotate so that the cutter can work by a lever mechanism in which the push pin acts on a lever portion of the cutter on the other side of the axis from the cutting edge of the blade.

The liquid duct of the dispensing device is positioned to intersect the diluent duct before the mixing chamber. The metering and mixing form of the dispensing device preferably comprises, to complement the liquid metering pump, a means for increasing the speed at which the diluent arrives at the point where the streams meet. Such a means is preferably a restriction in communication with the diluent intake situated upstream of the mixing chamber so that the flow of diluent is accelerated through the restriction.

The means for accelerating the speed of the diluent can comprise a venturi means in the form of at least one restriction situated at the diluent duct before or where the streams meet. Thus, the restriction makes it possible to accelerate the flow of diluent when it meets the liquid, and therefore makes it possible advantageously to lower the pressure. Such a principle is simple to implement because it does not involve any moving parts. The diluent meets the metering liquid at a relatively high speed, producing shear effects and also preventing the diluent from rising back up inside the liquid metering duct. The speed of the fluid then drops in the mixing chamber which, of larger cross section, encourages the creation of a homogeneous liquid-diluent mixture inside the chamber.

The diluent duct is preferably directed toward the outlet of the liquid metering duct or slightly below it to ensure that the diluent and liquid streams collide relatively one another. In a possible mode the diluent and liquid metering ducts are directly positioned in intersection. In alternative modes, the two ducts are positioned to terminate each one separately in an enlarged mixing chamber but still in intersection of their streams.

As a preference, the diluent duct comprises at least one terminal portion which, with the restriction and the inlet to the mixing chamber, forms an alignment. The liquid duct at the pump outlet for the passage of the liquid is transversal to the said alignment. This configuration affords a particularly effective venturi effect in which the diluent is displaced more or less linearly to create a sufficiently great pressure reduction. The pressure reduction is also capable of drawing the liquid through the duct at the pump outlet when the pump is switched off without the diluent rising back up inside the said liquid duct. The term "alignment" is to be understood as meaning that there are no elbows or sharp bends likely to break or significantly slow the flow of diluent through the restriction.

According to one possible aspect, the dispensing device is configured in such a way as to be able to produce a frothy preparation. The device can comprise an air intake communicating with at least one of the ducts before the mixing chamber, or in the mixing chamber itself, to carry air into the mixture and cause the preparation to froth. As a preference, the air intake is positioned in communication with the restriction in order to benefit from the suction created and carry in air and froth at least some of the diluted liquid, for example a drink, in the mixing chamber. The air intake is thus sized in such a way as to carry the required quantity of air into the mixing chamber. The air may also be used at the end of the delivery operation to clean the chamber and expel therefrom at the very end of the delivery cycle any amount of drink and/or froth and/or diluent that may still remain in the chamber.

In one mode, the air intake is positioned relatively to the diluent duct and the liquid metering duct for the air to be sucked in the diluent stream before the diluent stream intersects or collides with the liquid stream. For instance, the air intake can be placed in intersection of the diluent duct before the point of collision between the diluent stream and the liquid stream. In this arrangement, air bubbles are sucked in the diluent stream before the diluent mixes with the liquid. The point of collision between the aerated diluent and liquid may be placed in the mixing chamber or before the mixing chamber, i.e., at the intersection of diluent and liquid ducts. This arrangement solves a problem of contamination of the air intake. Due to velocity and the pressure difference created, the diluent does not enter the air channel and therefore the air channel cannot be cleaned by a flush cycle of the diluent. As a result, this can cause a problem of bacteria growth. By having the air intake at the diluent level only, one ensures that product such as diluted liquid concentrate does not contaminate the air conduit.

Frothing of the product dispensed, a drink for example, may be obtained when the suction means additionally comprise an air intake allowing air to be carried in to the mixture and to froth the liquid-diluent mixture in the mixing chamber. An air intake may, however, be omitted or be selectively closed off when the preparation does not need to be frothed. The cross section of the air intake can vary according to the nature of the food liquid contained in the package. Thus, the cross section of the air duct may vary between 0.05 and 2 $mm^2$, preferably 0.1 and 0.5 $mm^2$.

The dispensing device preferably has a venting valve having associated opening means for venting the liquid duct in particular when the container attached to the dispensing device is made of a rigid or semi rigid material. The opening means can for example be arranged to open the venting valve after passage of liquid through the duct. The opening means can for example comprise a piston, which can be operated by the means for driving the pump, in sequence after operation of the pump to dispense a measured amount of liquid. When the container attached to the dispensing device is made of a supple material of example of the pouch type, the venting means can be omitted.

The liquid may be a food concentrate intended to reconstitute a hot or cold, frothy or non-frothy drink. For example, the liquid is a concentrate based on coffee, cocoa, milk, tea, fruit juice or a combination of these components. The concentrate may be a liquid for producing a cafe latte for example, comprising a coffee concentrate and condensed milk or a creamer. The viscosity of the liquid may vary according to the nature of the concentrate. Typically, the viscosity is between 1 and 5000 cPoise, preferably 200 to 1000 cPoise, more preferably still between 300 and 600 cPoise.

BRIEF DESCRIPTION OF THE SEVERAL VIEW OF THE DRAWINGS

The characteristics and advantages of the invention will be better understood in relation to the figures which follow:

FIG. 1A depicts an overall perspective view of the preparation system according to the invention comprising a multi-portion package fitted with the dispensing device of the invention in a position separate from the base station, FIG. 1B depicts a view similar to FIG. 1B with the dispensing device of the invention in a docked position on the base station FIG. 2 depicts an exploded perspective view of a dispensing device according to the invention, showing the two half-shells of the device and the outer cover, viewed from the side having an outer cover, FIG. 3 depicts an exploded perspective view of the dispensing device of FIG. 2, showing the two half-shells of the device and the outer cover, viewed from the opposite direction from FIG. 1;

DETAILED DESCRIPTION OF THE INVENTION

Figure 1A:
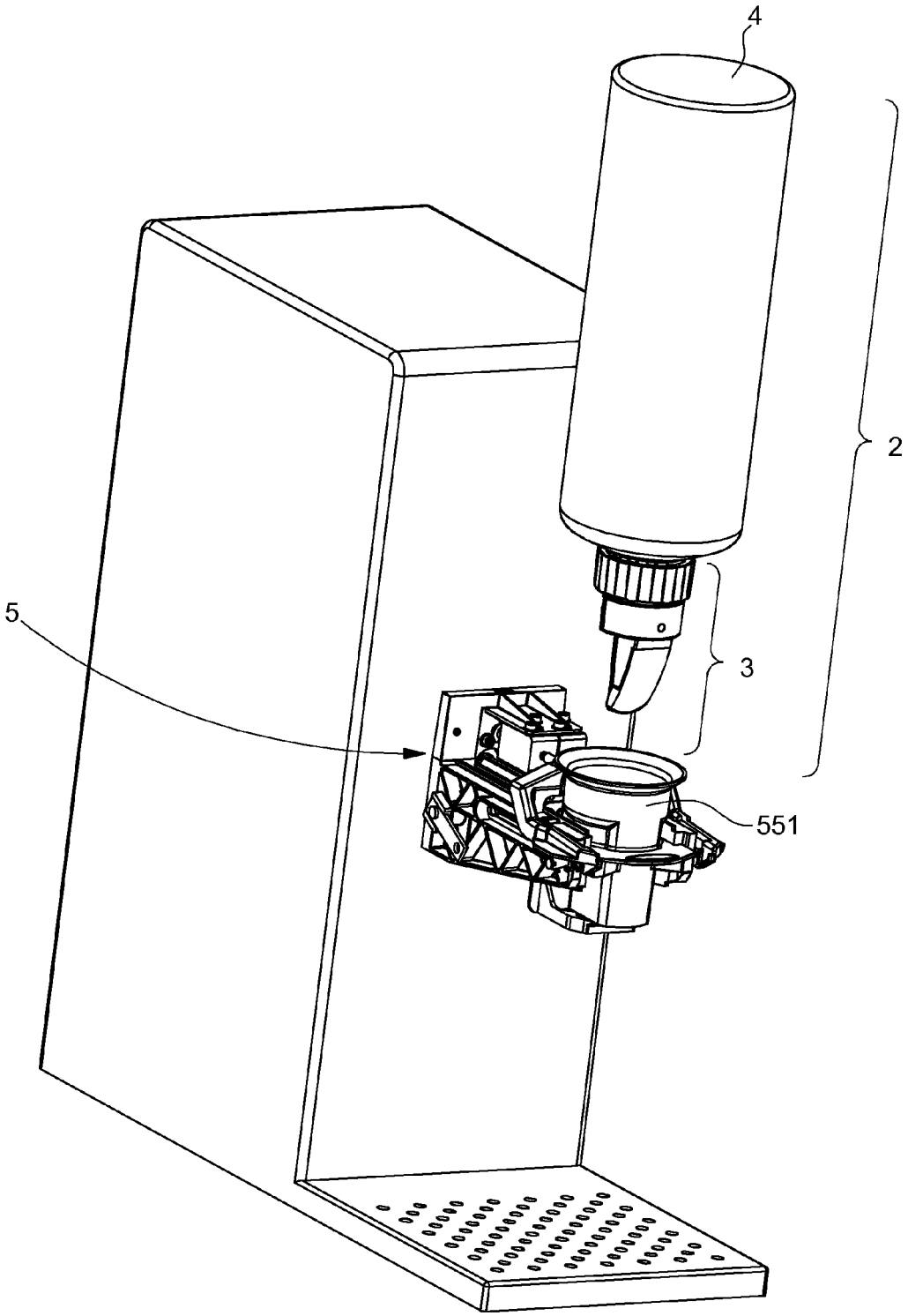
Figure 1B:
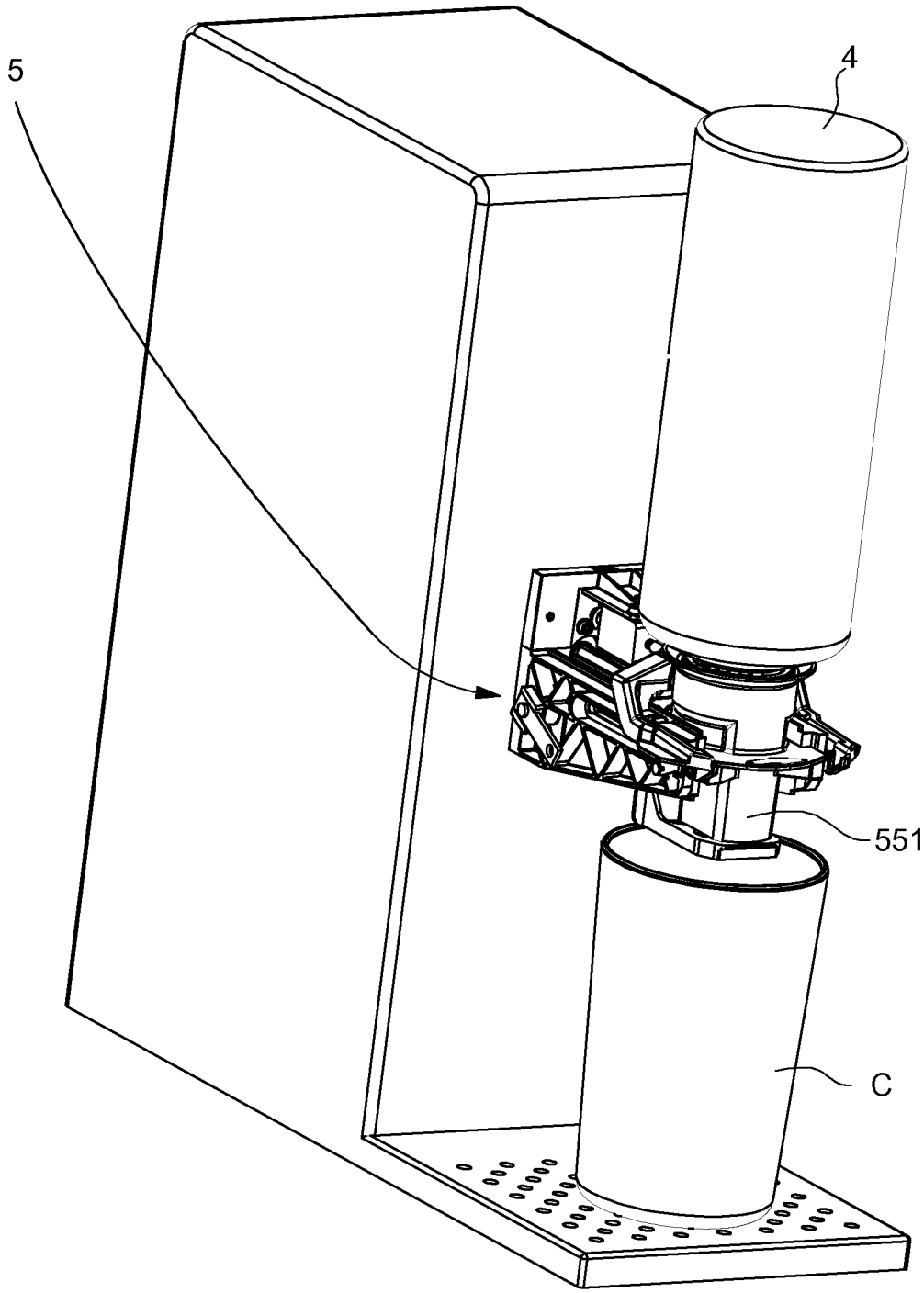
Figure 2:
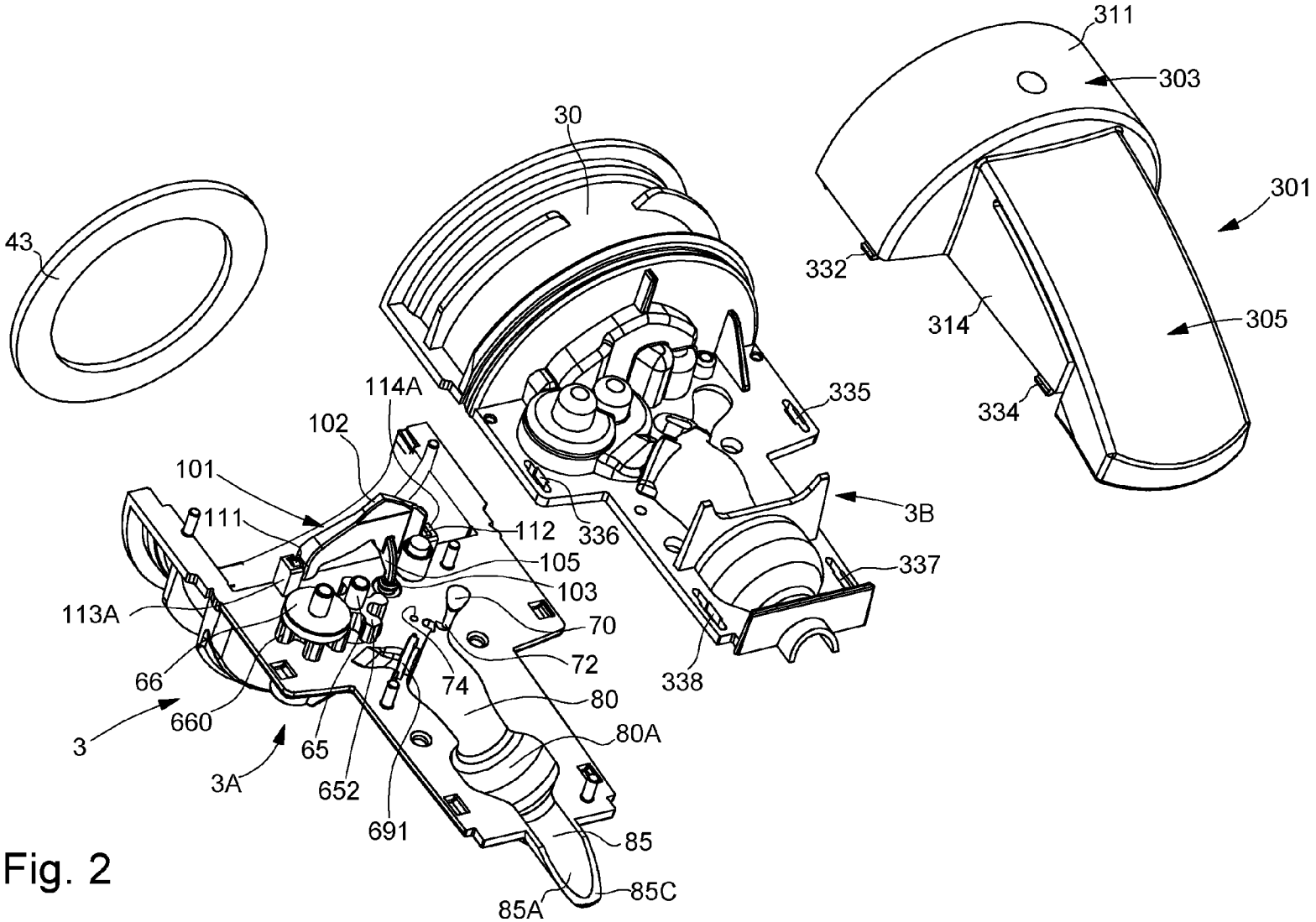

The dispensing system for reconstituting and delivering food preparations according to the invention, in particular for preparing hot or cold drinks, shown in the Figures and particularly in FIGS. 1A and 1B comprises at least one functional package 2 formed of a metering and mixing device 3 and of a container 4 and, on the other hand, a base station 5 which serves to anchor the functional package 2 with a view to preparing and delivering the drinks through the metering and mixing device 3 into a cup C. The device 3 is connected to a container 4 which may be of any kind, such as a bottle, which generally does not contract when liquid is dispensed, or a brick, a sachet, or a pouch or the like which does contract when liquid is dispensed. The container contains a food liquid intended to be diluted with a diluent, generally hot, ambient-temperature or chilled, water, supplied to the metering device 3 via the base station 5. The liquid may be a concentrate of coffee, milk, cocoa, fruit juice or a mixture such as a preparation based on coffee concentrate, an emulsifier, flavourings, sugar or artificial sweetener, preservatives and other components. The liquid may comprise a purely liquid phase with, possibly, solid or pasty inclusions such as grains of sugar, nuts, fruit or the like. The liquid is preferably designed to be stable at ambient temperature for several days, several weeks or even several months. The water activity of the concentrate is thus usually set to a value that allows it to keep at ambient temperature for the desired length of time.

The metering and mixing device 3 and the container 4 are preferably designed to be disposed of or recycled once the container has been emptied of its contents. The container is held in an inverted position, its opening facing downwards and its bottom facing upwards, so as to constantly supply the metering and mixing device 3, particularly the liquid metering pump contained therein, with liquid under gravity. The container 4 and the device 3 are connected by connecting means which may be detachable or permanent as the case may be. It is, however, preferable to provide permanent-connection means in order to avoid excessively prolonged use of the metering and mixing device which, without cleaning after an excessively lengthy period of activity, could end up posing hygiene problems. A permanent connection therefore forces the replacement of the entire package 2 once the container has been emptied, or even before this if the device remains unused for too long and if a hygiene risk exists. However, the inside of the device 3 is also designed to be able to be cleaned and/or rinsed out with diluent, at high temperature for example regularly, for example during rinsing cycles that are programmed or manually activated and controlled from the base station 5.

FIGS. 2 to 9 show the metering and mixing device 3 of the invention in detail according to a preferred embodiment. The device 3 is preferably in the form of a cap which closes the opening of the container 4 in a sealed manner when the container is in the inverted position with its opening facing downwards. The cap has a tubular connecting portion 30 equipped with connecting means such as an internal screw thread 31 complementing connecting means 40 belonging to the container, also of the screw thread type for example. The inverted position of the container is necessary only if the container is rigid and does not contract as it empties. If the opposite is true, such as in the case of a bag which contracts without air entering, the liquid can be dispensed and metered when the container is in a position which is not necessarily the inverted one.

The device 3 is preferably made up, amongst other things, of two half-shells 3A, 3B assembled with one another along a parting line P running more or less in the longitudinal direction of the ducts, particularly of the liquid duct and of the mixing chamber, circulating within the device. The construction in the form of two half-shells, namely a rear part 3A and a frontal other part 3B, makes it possible to simplify the device while at the same time defining the succession of ducts and chambers needed for metering, mixing, possibly frothing, and delivering the mixture.

The outlet 32 of the container 4 has a tamper resistant foil 41 positioned across it to seal the container. The foil 41 is held in position by welding or joining techniques, e.g. such as induction or conduction welding. The sealing ring 43 aids in the prevention of leakage when foil 41 has been pierced/cut. The device 3 comprises a cutter 101 for piercing the foil 41. Means 103 for actuating the cutter 101 are operable from outside the device 3 so that when the device is connected to the base station 5 perforation can be performed by drive means 541 which form part of the base station. The device 3 can be assembled on the container 4 by screw threads 31, 31A without breaking the foil 41. The foil 41 need not be breached until the container 4 and dispensing device 3 have been connected to each other and are connected to the base station 5. The cutter 101 can for example comprise a blade and the actuating means can comprise a push pin 103 urging the blade through the foil 41. The push pin has coupling means capable of engaging with drive means 541 of the base station 5.

However, in a variant (not shown) the cutter could also be actuated manually by a user to effect the perforation of the foil before the device is connected to the base station. In that case the push pin 103 could be arranged to protrude from the shell 3A so as to be easily actuated manually to effect the perforation of the foil 41.

Figure 4:
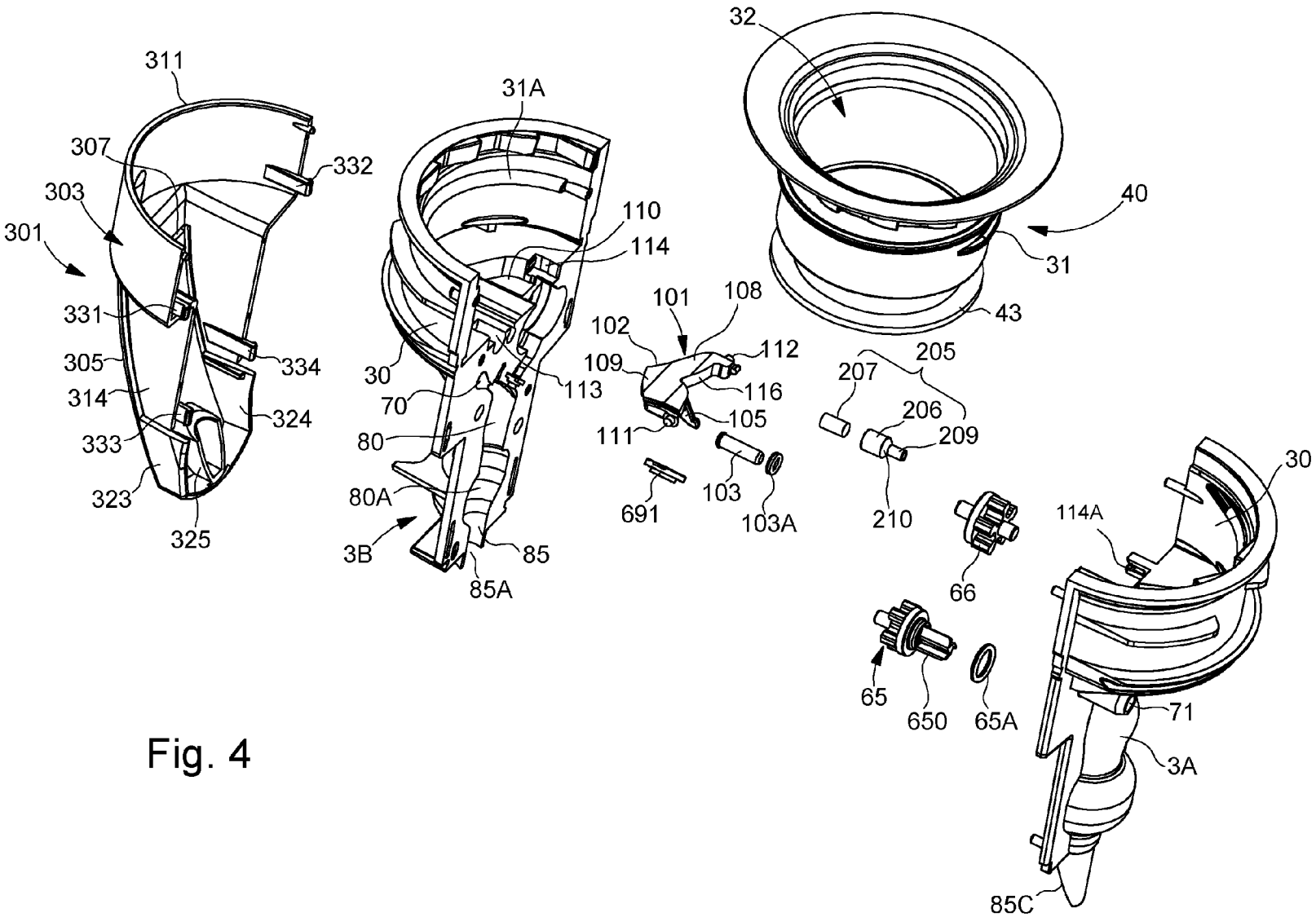
FIG. 4 depicts an exploded perspective view of the cutter of the dispensing device of FIG. 2 with the components of the half-shells disassembled.

The blade 101 has a V-shaped cutting edge 102 so as to form a V-shaped perforation in the foil 41. The cutter blade has a substantially flat (planar) portion 108 with a peak portion 109 including the V-shaped cutting edge 102 being raised upwards from the flat portion of the blade (FIG. 4). When the blade has perforated the foil it remains protruding through the foil.

The cutter 101 is mounted to rotate about an axis and comprises a lever portion 105 integral with the blade and on the other side of the axis from the cutting edge 102 so that the push pin 103 can act against the lever portion of the blade by a lever mechanism to urge the cutting edge of the blade through the foil 41. One half-shell 3B of the cap device is formed with a recess 110 which accommodates the cutter blade 101 in the position in which it does not pierce the foil 41. The recess 110 is formed with opposed laterally extending cylindrical recesses 113, 114 capable of receiving each a bearing member 113A, 114A. The flat portion 108 of the cutter blade is formed with outwardly projecting journals 111, 112 inserted for example by snap fitting into the bearing members 113A, 114A. The journals thereby define an axis about which the cutter blade 101 can rotate. The cutter can be operated by a lever mechanism in which the push pin 103 acts on the lever portion 105 of the cutter on the other side of the axis from the cutting edge 102 of the blade.

Figure 8:
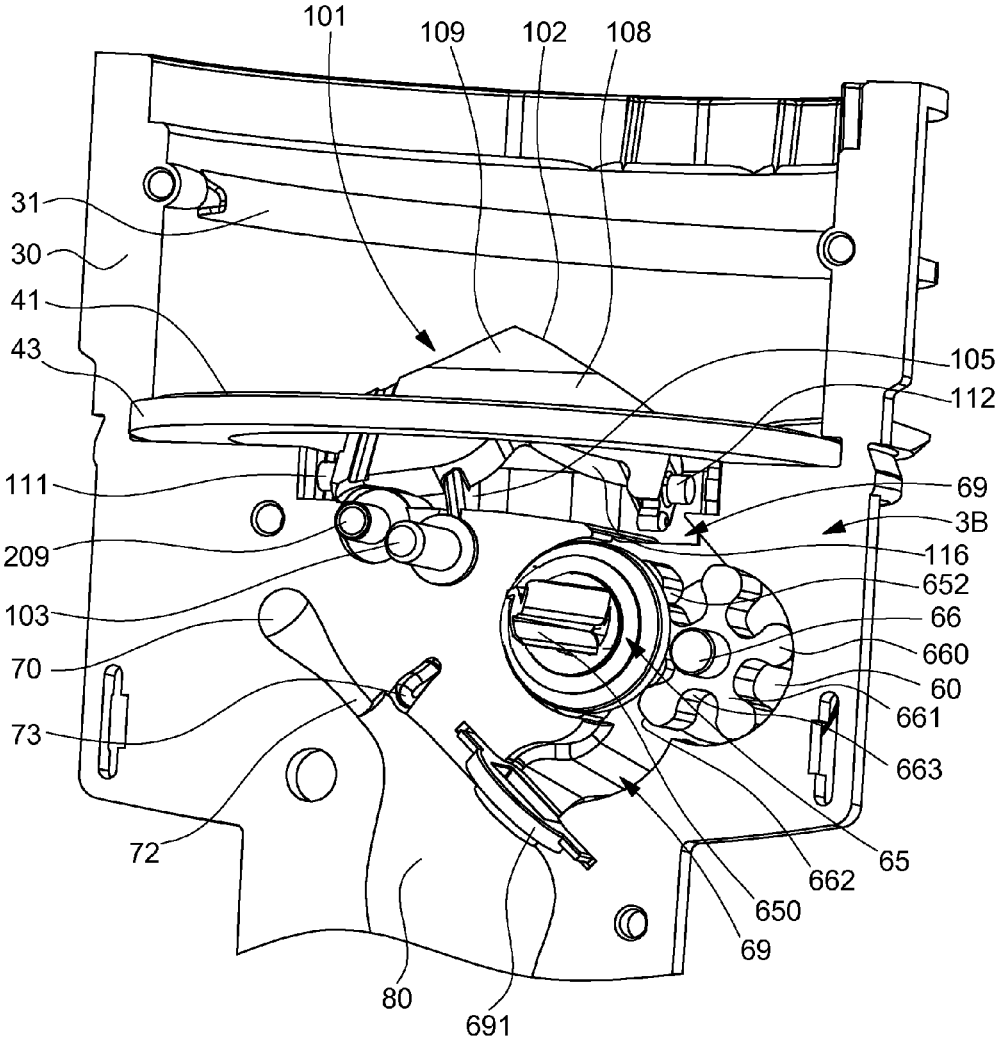
FIG. 8 is a part view of the device shown in FIG. 7 from a different angle, showing the cutter in more detail.

The rear portion of the cutter blade 101 has a V-shaped cutaway portion 116 substantially parallel to the V-shaped cutting edge 102. As seen in FIGS. 4 and 8, this cutaway portion 116 forms a clear inlet from the container 4 to the liquid duct 69, allowing flow of liquid through duct 69.

When the container is one that cannot contract, it may be necessary to provide an additional air inlet into the container in order to compensate for the withdrawal of the liquid. It is to be noted that during operation of the dispensing device, no air should come in unless desired, therefore push pin 103 is associated to a sealing ring 103A rendering air and liquid tight. If desired, venting air can be provided as will be discussed hereinafter. In that respect, cutter blade 101 could be provided with passageways to foster the venting air going upwards in the container. These passage ways could take the form a holes, or grooves, the idea being to prevent the venting going into the pump when the venting is activated in order to avoid dispensing the wrong amount of concentrate which would result in the production of a drink of bad quality.

Figure 7:
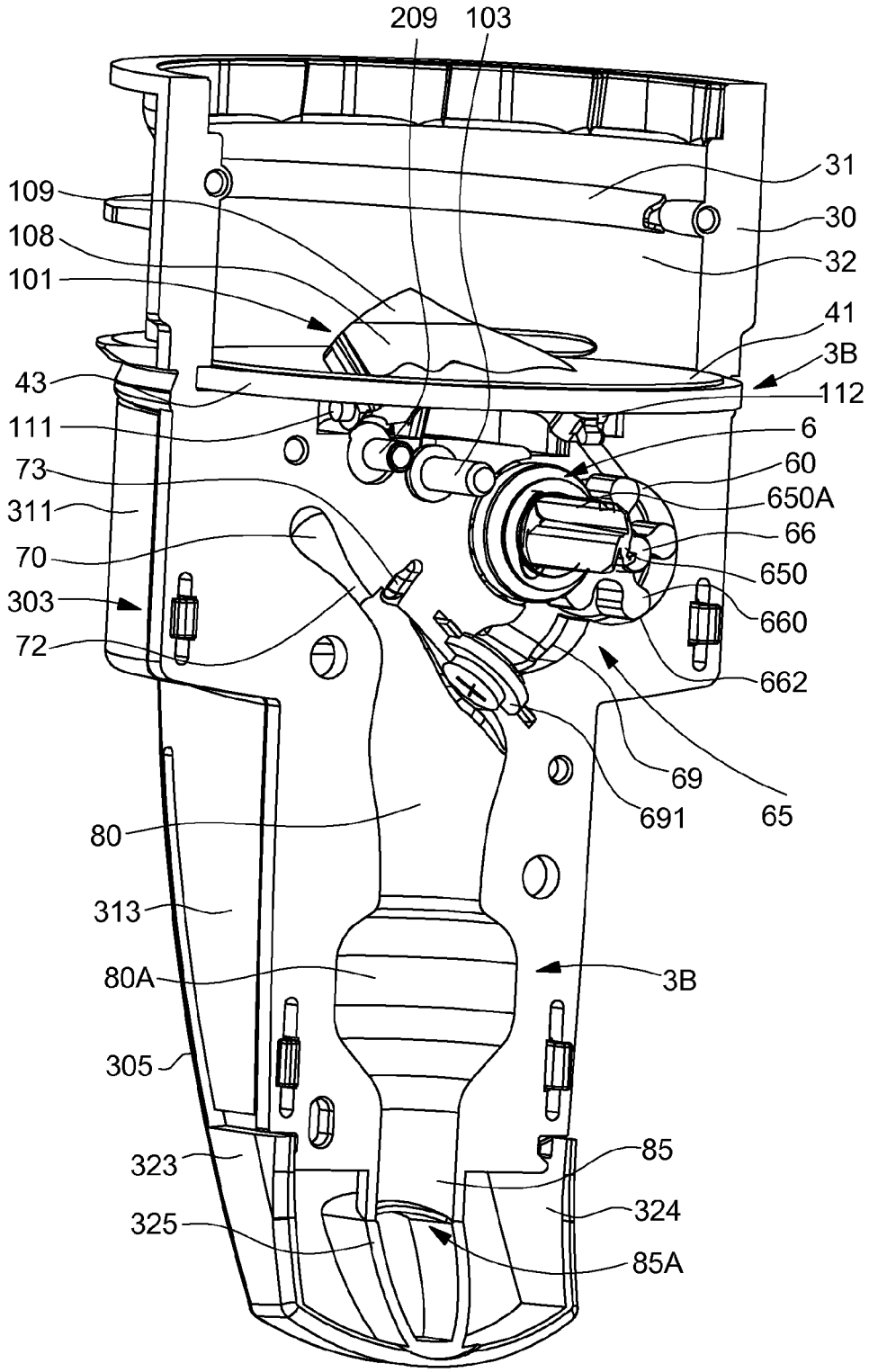
FIG. 7 depicts an internal view of the device of FIG. 2 after the cutter has pierced the foil.

The metering and mixing device 3 comprises a built-in metering pump 6 for metering the liquid passing through the opening 32 (FIG. 7). The pump is preferably a gear pump as described in WO-A-2006/005401 and is defined by a chamber 60 equipped with bearings present at the bottom of each lateral surface of the chamber and able to guide two rotary elements 65, 66 cooperating in a geared fashion in order to form the moving metering elements of the pump in the chamber. The rotary element 65 is a "master" element equipped with a shaft 650, on which an optional sealing ring 65A is mounted, associated with a coupling means 650A able to engage with a complementary coupling means belonging to the base station 5 (described later on). A lip seal is preferably incorporated between the bearing and the shaft 650 to seal the pump chamber with respect to the outside. The internal pressure when the pump is in motion helps with maintaining sealing by stressing the seal. The rotary element 66 is the "slave" element which is driven in the opposite direction of rotation by the master element in order to be able to meter the liquid through the chamber 60. The construction in the form of half-shells is such that the chamber 60 is defined by the assembly of the two parts 3A, 3B. The chamber 60 may thus be defined as a hollow in the frontal part 3B with a bottom surface defining one of the lateral surfaces. The other part encloses the chamber via a more or less flat surface portion, for example, comprising the bearing that supports the drive shaft 650, which is extended backwards through a passage 78 through the shell part 3B.

The liquid is thus metered through liquid outlet duct 69. The diameter is of the order of 0.2 to 4 mm, preferably 0.5 to 2 mm. The duct 69 allows fine control over the flow rate of liquid leaving the pump and makes it possible to form a relatively narrow flow of liquid, thus encouraging fine metering.

A barrier valve 691 is positioned in the liquid duct 69 downstream from the pump 6. The valve can be any sort of non-return valve such as a slit valve of the type shown in FIG. 14 of WO-A-2006/005401. The valve may comprise an elastomeric or silicone slit valve member or layer 691 maintained transversally in the liquid duct 69 by two rigid plies such as two metal plates. The valve 691 can be inserted through slots provided through the two half-shells 3A, 3B. The slit valve member is configured so that the slits open downwardly when a fluid pressure has built up upstream the valve as a result of the pump 6 being activated. As soon as the pump is stopped, the valve is resilient enough to close off the outlet.

The device 3 has hole 203 (FIG. 3) associated with opening means for letting in venting air in the device. The opening means comprise a piston 205 having a piston rod 206 extended by a piston pin 209 of smaller diameter via a conical connecting portion and a piston spring 207 made for example of silicon When the half shells 3A and 3B are assembled, piston spring 207 urges piston rod against half shell 3A so that piston pin 209 passes through hole 203 and tightening portion 210 abuts against the periphery of hole 203 on the inner side of half shell 3A thereby blocking the air entrance from the exterior. The piston pin 209 for the piston 205 is arranged to be activated upon demand by appropriate means arranged on the docking station which can press on the end of piston pin 209 against piston spring 207 to allow tightening portion 210 to move away from hole 203 and allow venting air to enter the dispensing device The device comprises a duct 70 for supplying diluent which intersects the liquid duct 69. The diluent is conveyed into the device through a diluent intake 71 located through the rear part 3A of the cap. This intake has the form of a connecting tube able to be forcibly fitted with sealing into a tubular coupling and diluent-supply part located on the base station 5. The diluent flow rate is controlled by a diluent pump situated in the base station 5. The diluent duct 70 ends in a restriction 72 beginning more or less upstream of the point where the liquid and diluent ducts 69, 70 meet. In the embodiment shown in FIGS. 2 to 9, as seen in FIGS. 7 and 8, the diluent duct 70 and the liquid metering duct 69 are not directly positioned in intersection one another but meet with the mixing chamber 80. The diluent duct 70 is nevertheless positioned in such a way that its stream is directed toward the liquid stream, i.e., in the direction of the liquid outlet or slightly below. Alternatively the liquid and diluent ducts can meet upstream of the chamber 80 so that the same duct transports the fluids to the chamber 80. Such a duct may widen to reduce the pressure drop and take account of the increase in volume of the fluids before extending into a mixing chamber 80 proper.

The restriction makes it possible to accelerate the diluent and this, using a venturi phenomenon, causes a pressure at the meeting point that is lower than or equal to the pressure of the liquid in the liquid outlet duct 69. When the pump is switched off, this equilibrium or differential of pressures, ensures that the diluent crosses the metering point and travels as far as the chamber without rising back up inside the liquid duct. The liquid pump stops while the diluent continues to pass through the device, for example towards the end of the drink preparation cycle in order to obtain the desired dilution of drink. Likewise, the diluent is used to regularly rinse the device. Thus the liquid, for example a coffee or cocoa concentrate, is prevented from being contaminated in the container or the pump by diluent being sucked back through the duct 69.

The restriction 72 is thus sized to create a slight decrease in pressure of the diluent at the meeting point. However, the pressure needs to be controlled so that it does not excessively lower the boiling point and cause the diluent to boil in the duct 70 when hot drinks are being prepared. For preference, the restriction has a diameter of between 0.2 and 5 mm, more preferably between 0.5 and 2 mm.

Figure 9:
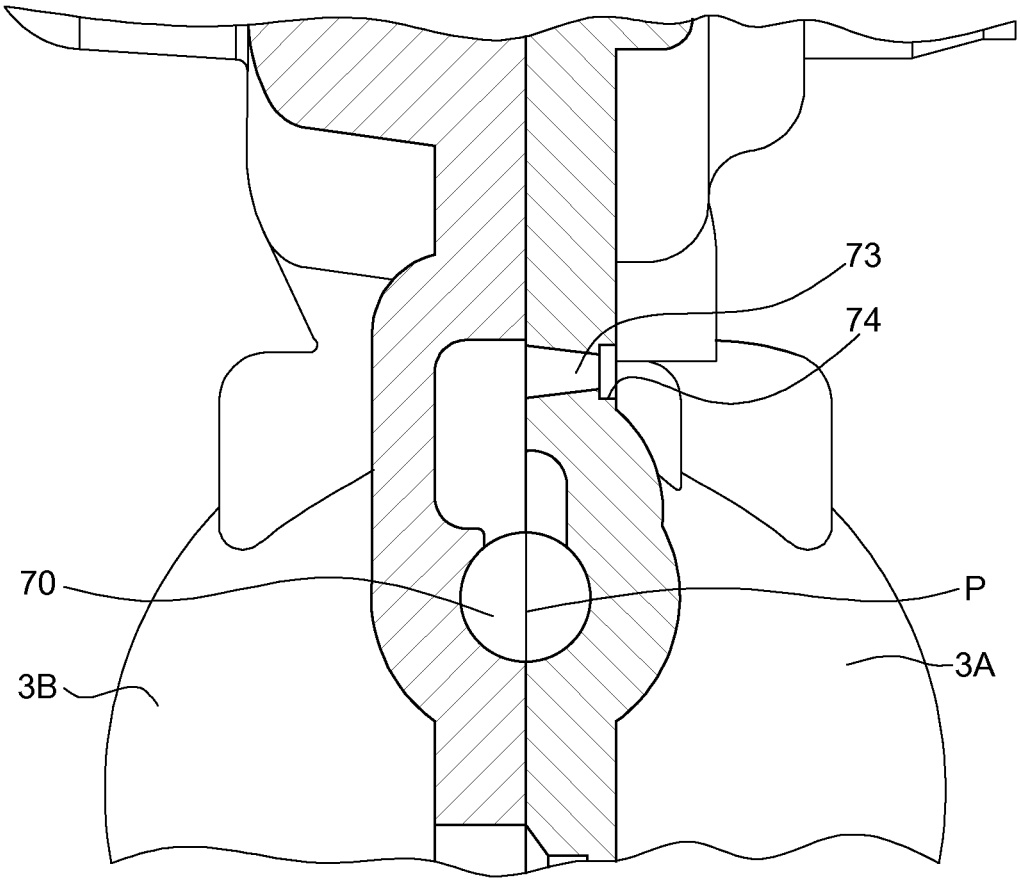
FIG. 9 is a partial cross-section of the device of FIG. 2 showing the air inlet in more detail.

An air intake embodied by an air duct 73 open to the open air via a hole 74 provided in half shell 3A is preferably provided when frothing of the liquid-diluent mixture is desired. As illustrated in FIG. 9, the air intake or channel 73 can be placed to intersect the diluent duct 70. Therefore, it is placed before the intersection of the liquid stream and diluent stream. The air intake 73 may be provided in the region of the restriction 72. The diluent speed is such in that region that air is sucked in the diluent stream before the stream meets the liquid stream. Such an arrangement reduces the risk of the air intake being contaminated with the diluted product coming in the air intake by accident. The position of the air intake may vary and may also be sited in such a way as to lead to the diluent duct 70 or alternatively to the liquid duct 69.

In a possible mode (not illustrated), an air pump can be connected to the air intake. The air pump can be used for creating a positive pressure in the air intake which can force air to mix with the diluent stream. Normally, the restriction of the diluent duct is enough to draw a sufficient amount of air to create bubbles in the mixture but an air pump could prove to be helpful, in particular, at elevated diluent temperatures, where steam may start forming in the device thus resulting in no sufficient air to be able to be drawn. The air pump may also be used to send air in the mixing chamber at the end of the dispensing cycle in order to empty the chamber of the mixture and/or to dry off the mixing chamber for hygiene purpose. The air intake should also be connected to atmospheric pressure at the end of the dispensing cycle to ensure that the mixing chamber can properly empty. Such atmospheric pressure balance can be obtained by an active valve placed at the higher point in the air feed system. The mixing chamber 80 has a width of the order of at least five times, preferably at least ten or twenty times, the cross section of the duct portion 73 more or less at the exit from the meeting point. A broad chamber is preferable to a simple duct to encourage mixing and also to prevent any liquid from being sucked back into the venturi system when the device is at rest, as this could detract from the maintaining of good hygiene in the device. However, in principle, the chamber could be replaced by a duct of smaller cross section.

The chamber 80 also allows the mixture to be decelerated and therefore avoids the mixture being expelled too abruptly and possibly causing splashing as it is delivered. For that, the chamber 80 can have a bowed shape, or even can have the shape of a S so as to lengthen the path of the mixture and reduce the speed of the mixture.

The chamber 80 is connected mainly to a delivery duct 85 via an enlarged portion 80A for delivering the mixture. A siphon passage may also be provided in order to completely empty the chamber when the chamber has bowed shape, after each delivered drink cycle.

The duct 85 can comprises elements (not shown) for breaking down the kinetic energy of the mixture in the duct. These elements may, for example, be several walls extending transversely to the duct and partially intersecting the flow of mixture and forcing this mixture to follow a sinuous path. These elements may also have a function of homogenizing the mixture before it is let out. Of course, other forms are possible for breaking the flow of the liquid product.

Figure 3:
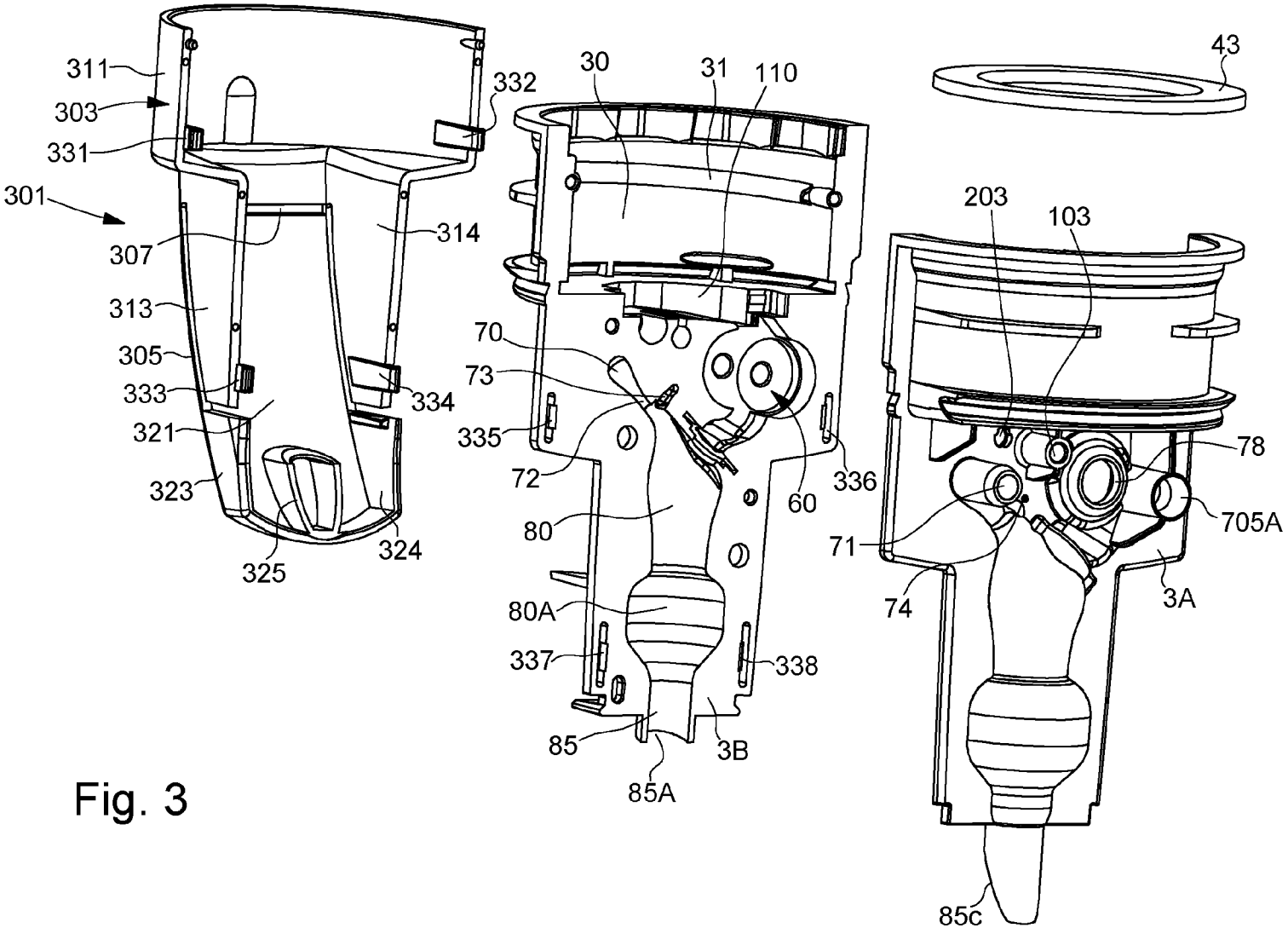
Figure 5:
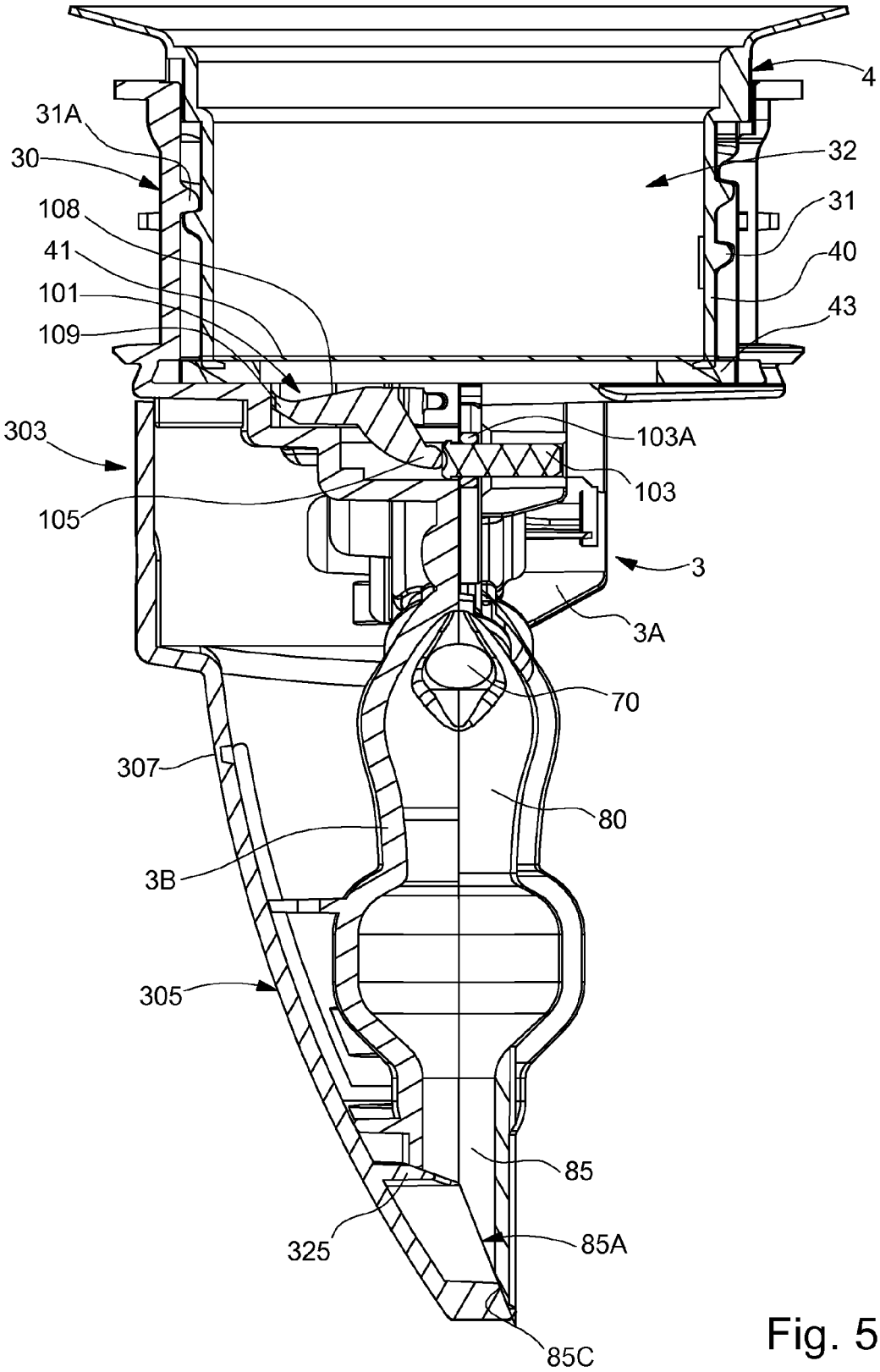
FIG. 5 depicts a cross-sectional view of the assembled device of FIG. 1 attached to a container, before the cutter has pierced the foil of the container.
Figure 6:
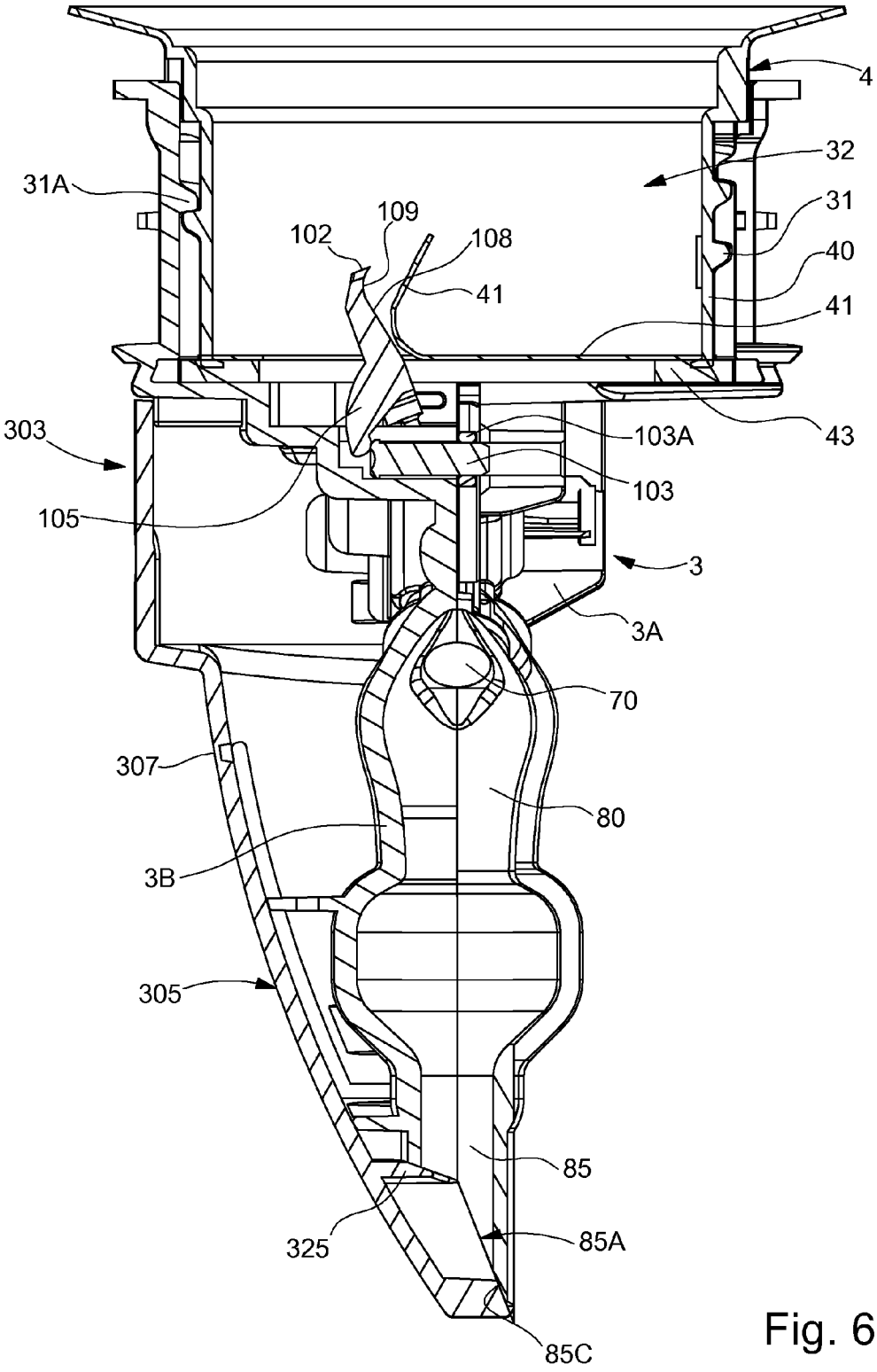
FIG. 6 depicts a cross-sectional view of the device of FIG. 2 attached to a container, after the cutter has pierced the foil of the container.

The cap device 3 has an outer cover 301 which closes the outlet 85A of the liquid product duct 85 when the device 3 is not in use, particularly when it is not connected to the base station 5. The cover 301 comprises a fixed portion 303 and a movable portion 305 joined by a hinge 307 (FIGS. 3, 5 and 6). The fixed portion 303 is securely attached to the half-shell 3B of device 3. The fixed portion 303 has hooks (331, 332, 333, 334) which fit in holes (335, 336, 337, 338) in the half-shell 3B. The fixed portion comprises a body portion 311 remote from the outlet 85 and side portions 313, 314 positioned below the hinge 307 and to either side of the movable portion. The cover 301 is made of hard plastics material and the hinge 307 is a linear section of plastics material thinner than the fixed portion 303 and movable portion 305.

The movable portion 305 of the cover is movable between a position shown in FIGS. 5 and 6 which closes outlet 85A and a position which opens outlet 85A. The movable portion 305 can be opened by the base station 5 as described below. In practice the movable portion would be opened by the base station as the cutter is operated as shown in FIG. 6. The movable portion 305 comprises a central portion 321 adjacent the hinge 307 attached to side pieces 323, 324 arranged below the side portions 313, 314 of the fixed portion. The side pieces 323, 324 can be engaged by opening means on the base station 5. Opening of the movable portion 305 can be performed by movement of the drawer of the base station. The movable portion 305 of the cover 301 is a snap fit on the lower portion of the device 3 in a position which closes outlet 85A. The central portion 321 of the movable portion 305 has a raised section 325 on its inner surface which forms a support on which the edge 85C of the outlet duct 85A can rest when the outer cover 301 is closed.

The dispensing device according to the invention also preferably comprises guide means allowing docking with the base station and, in particular, facilitating alignment of the diluent coupling and pump drive means. These guide means may, for example, be portions of surfaces through the device, for example, transversely to the parts 3A, 3B. The surfaces may, for example, be partially or completely cylindrical portions. The guide means also perform the function of supporting the weight of the package and ensure firm and stable docking. These means may of course adopt other highly varied shapes.

The parts 3A, 3B are assembled by any appropriate means such as welding, bonding or the like. In a preferred embodiment, the two parts are laser welded. The laser welding may be computer controlled and has the advantage of welding the parts together without any movement, unlike vibration welding; this improves the compliance with dimensional tolerances and the precision of the welding. For laser welding, one of the parts may be formed in a material that is more absorbent of laser energy while the other part is made of a plastic transparent to laser energy. However, other welding techniques are possible without departing from the scope of the invention, for example vibration welding.

It is preferable to provide a connecting joint (not shown), such as a weld, which partially or completely borders the ducts and chambers of the device. The joint is preferably perfectly sealed. However, a joint with non-welded regions may be provided in order to control the entry of air into the device.

In an advantageous construction, the rotary elements 65, 66 of the liquid pump each have teeth 652, 660 of complementing shapes, the cross section of which has a rounded shape towards the ends with an area of restricted cross section 661 at the base of each of the teeth. Such a rounded tooth geometry makes it possible to create a closed volumetric metering region which does not experience compression and transports a volume of liquid that is constant for each revolution. This configuration has the effect of reducing the effects of compression on the metered liquid and this improves the efficiency of the pump and reduces the loads on the pump. As a further preference, the outermost portion 662 of each tooth is flattened with a radius greater than the radius of the sides 663 of each tooth. In particular, the flattening of the outermost portions 662 allows the teeth to be brought closer to the surface of the pumping chamber, thus reducing clearance and improving sealing.

The device may comprise several liquid pumps each comprising a liquid duct which meets the diluent duct. The advantage is then that of being able to mix several different liquids with flow rate ratios determined by each of the pumps. The pumps may be organized either in the same plane or in a parallel plane. The container may comprise several chambers containing different liquids, each chamber communicating with its corresponding pump. Thus, the preparation of a drink may comprise two components which have to be kept separate for reasons of stability, shelf life, or preferably, for example, a base of concentrate on the one hand and a flavouring on the other, thus metered by different pumps to reconstitute a flavoured drink or a drink with a better flavour. It is also possible to provide a separate diluent duct for each liquid duct.

The dispensing device 3 is used with a base station 5 of the type shown in FIGS. 10 to 18 of the accompanying drawings. The base station 5 comprises a holder 551 (not seen in FIG. 10 but in FIG. 11) for supporting the package comprising container 4 attached to dispensing device 3. The holder 551 is positioned at a fixed distance from the drive means 93 of the base station. The means 521 for coupling the drive of the base station to the pump 6, the means 541 for actuating the cutter 101 and the diluent coupling means 520, are movable towards holder 551 to connect the coupling means to dispensing device 3 and away from holder 551 after disconnecting from dispensing device 3.

The base station possesses an electric motor 93. The electric motor 93 comprises a drive shaft 524 which passes through and slides within a cylinder 525. The drive shaft 524 drives the coupling means 521 which can be connected to the dispensing device 3 to actuate the pump 6 for effecting passage of liquid through duct 69, and which can be disconnected from the device 3. The coupling means 521 is, for example, a portion of a shaft ending in a head of smaller cross section and with surfaces that complement the internal surfaces of the coupling means 650, 650A belonging to the metering and mixing device. The head may have a pointed shape of polygonal cross section or may be star shaped, for example, offering both speed of engagement and reliability in the rotational drive of the pump. Alternatively and as shown in FIG. 10A showing a detail of the drawer 701 the coupling means 521 could have the shape of a hollow shaft comprising inner longitudinal ridges 521A intended to cooperate with flexible wings 650A provided onto master gear 65. The coupling means 521 are supported by a drawer 701 drivable to move towards and away from holder 551 to effect the coupling with the corresponding means 650, 650A of the pump of the dispensing device 3. The drive shaft 524 is carried by the drawer 701 and mounted so as to rotate via two bearings 524A therein (FIG. 10B). When the drive shaft 524 moves towards and away from the holder 551, drive shaft slides in cylinder 525 while being rotatably connected to cylinder 525 be rotated to effect coupling independently of the drawer. The drawer 701 is mounted and moves between two parallel support members 703, 704 fixed to the panel of the base station 5. The support members 703, 704 each comprise guide rails 703A, 704A onto which the drawer 701 can slide via slide block members 701A extending sideways from the drawer 701 and parallel thereto.

The drawer 701 also carries diluent coupling means 520. The means 520 may be a portion of a tube the diameter of which complements the diameter of the diluent intake 71 of the metering and mixing device 3 so as to engage therewith. Assembly may be achieved using one or more seals 520A. In a variant, coupling means can comprise a non-return valve.

The base station comprises a diluent supply source, such as a reservoir of drinking water connected to a water pumping system. The water is then transported along pipes (not featured) as far as a water or diluent temperature control system (not shown). Such a system may be a heating system and/or a refrigeration system allowing the water to be raised or lowered to the desired temperature before it is introduced into the metering and mixing device 3. As a preference, the system according to the invention offers the possibility of varying the metering of the liquid according to the requirements via a control panel featured in the interface area, thanks to a selection of buttons each of which selects a specific drinks dispensing program. In particular, the liquid:diluent dilution ratio can vary by varying the speed at which the pump 6 is driven. When the speed is slower, the diluent flow rate for its part being kept constant, the liquid:diluent ratio is thus reduced, leading to the delivering of a more dilute drink. Conversely, if the liquid pump speed is higher, the concentration of the drink can be increased. Another controllable parameter may be the volume of the drink by controlling the length of time for which the diluent pump system is activated and the length of time for which the liquid pump is driven.

The drawer 701 also carries coupling means 541 for driving the push pin 103 which actuates the cutter 101. In the example shown, the coupling means 541 comprises an activating pin which is fixed with respect to drawer 701. Alternatively, the pin 541 could also be mounted in the drawer as to slide therein. However in this case, additional control means for activating this pin 541 should be provided on base station 5. The drawer 701 may also carry coupling means 543 for driving a piston 205 which effects venting of the container. The drawer 701 may also carry a pin 97 for controlling the supply of air to the air duct 73 to achieve foaming or no foaming of the liquid dispensed. This pin carries a rubber disc 98 at its end which is capable of blocking the air intake 74 of the device 3. The drawer 701 also carries a positioning pin 705 for locating the drawer in the correct position relative to the dispensing device i.e. the metering and mixing device 3

In the variant shown in FIG. 10A the drawer 701 can also carry a sensor S, for example a proximity sensor of the reed type for detecting the position of the drawer as well as the presence of the cap holder 551.

Figure 10:
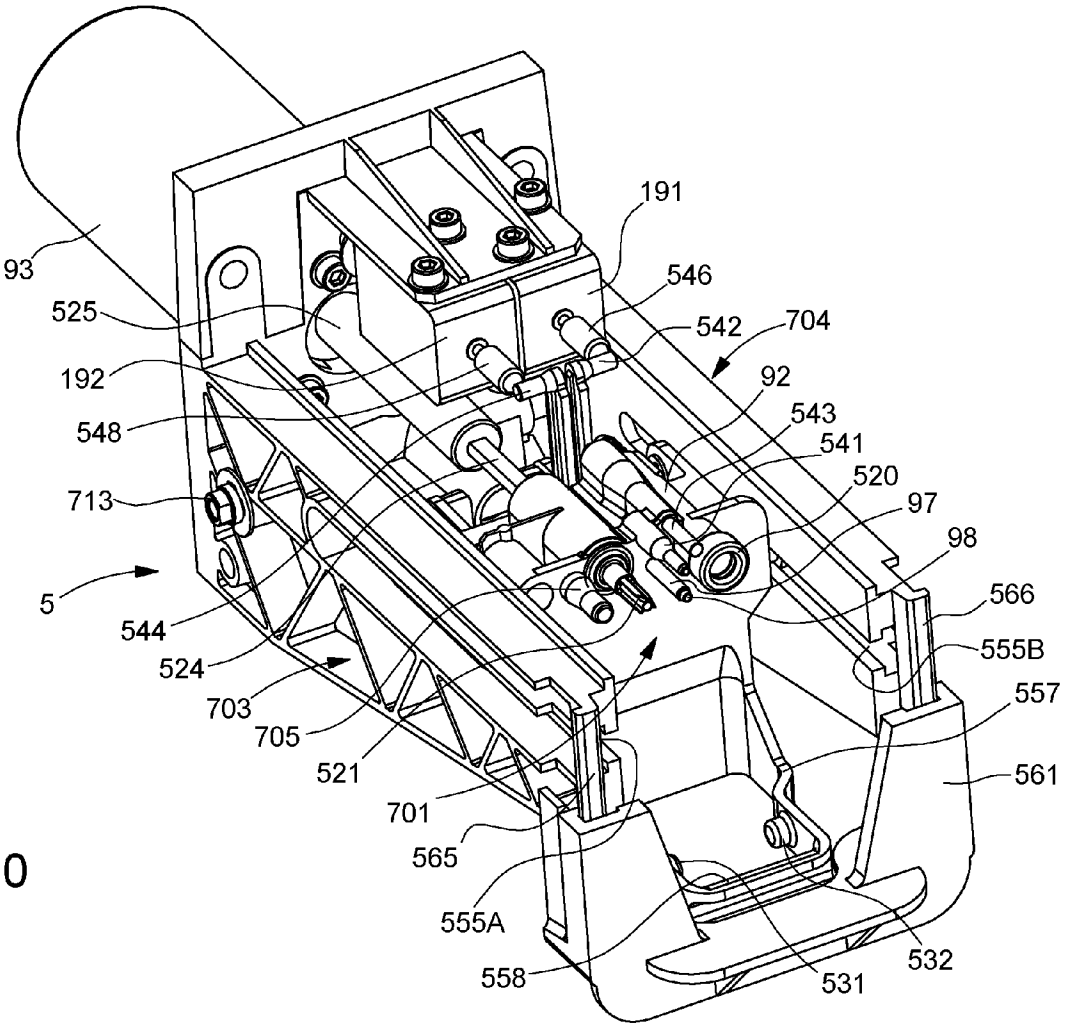
FIG. 10 depicts a side perspective view of a base station with the cap holder, not shown to allow a view of the coupling means for an alternative dispensing system according to the invention.
Figure 10A:
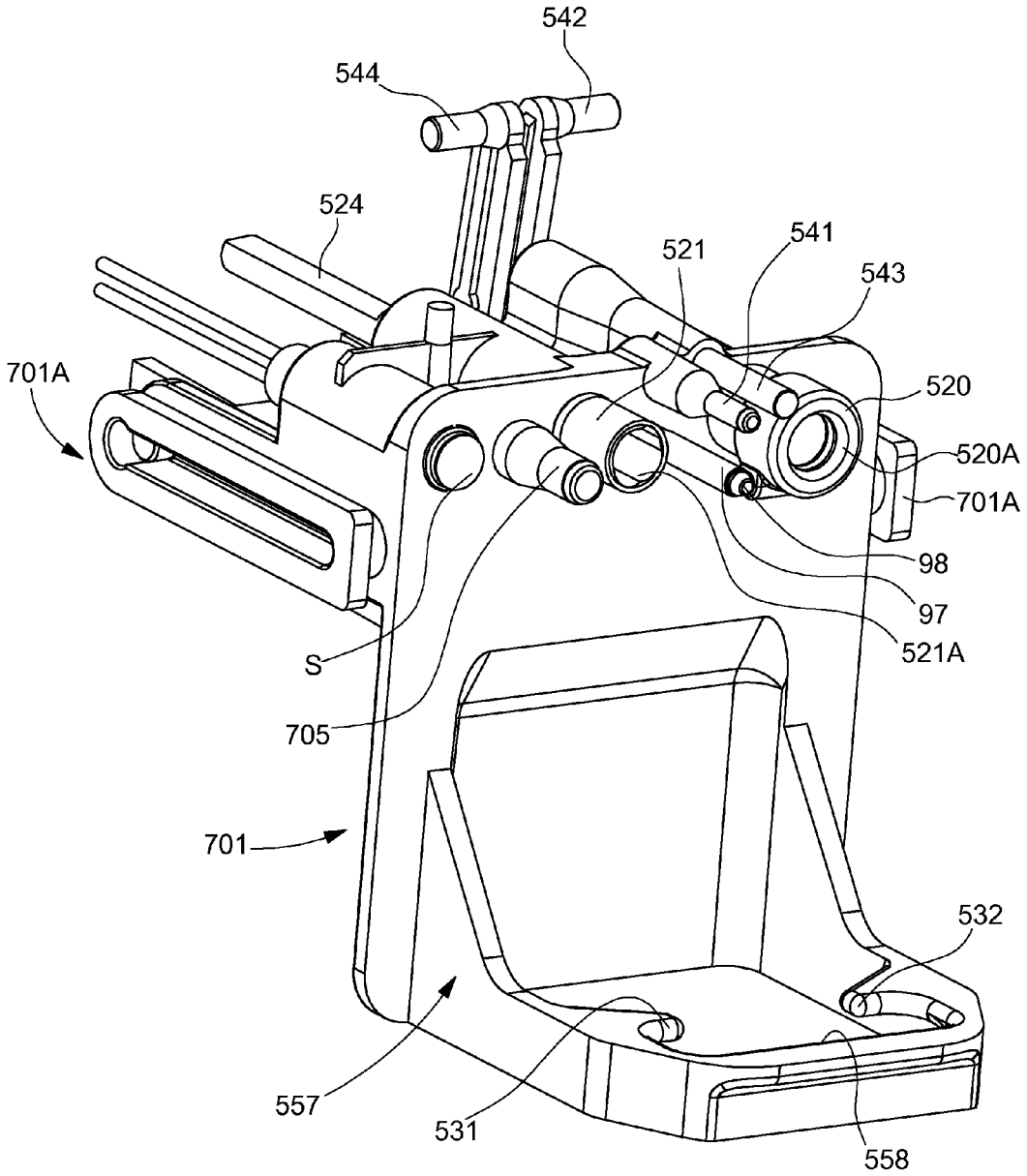
FIG. 10A depicts a detail of FIG. 10.
Figure 10B:
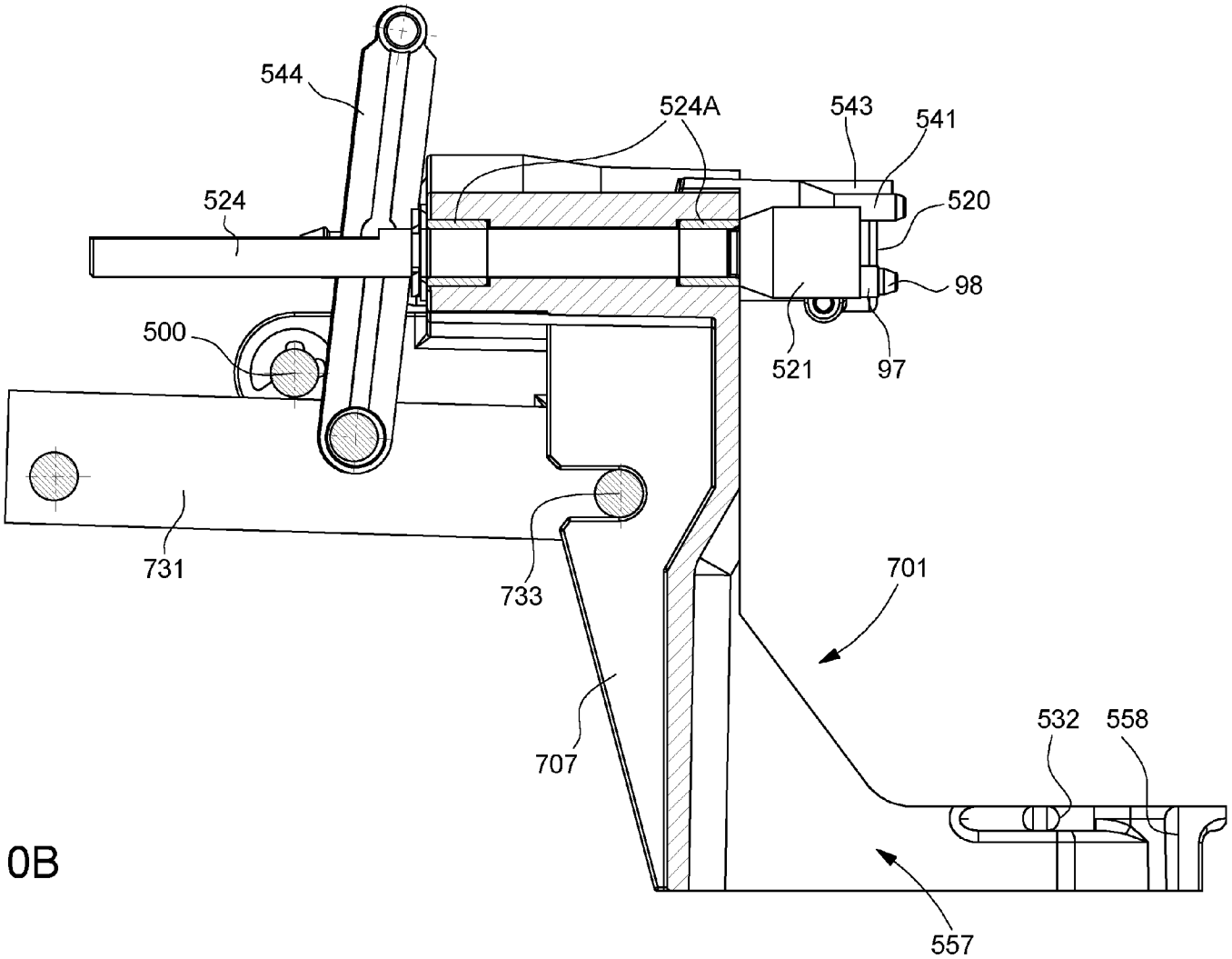
FIG. 10B depicts of cross section of the drawer shown in FIG. 10A through the coupling means for the driving of the pump of the dispensing device.
Figure 10C:
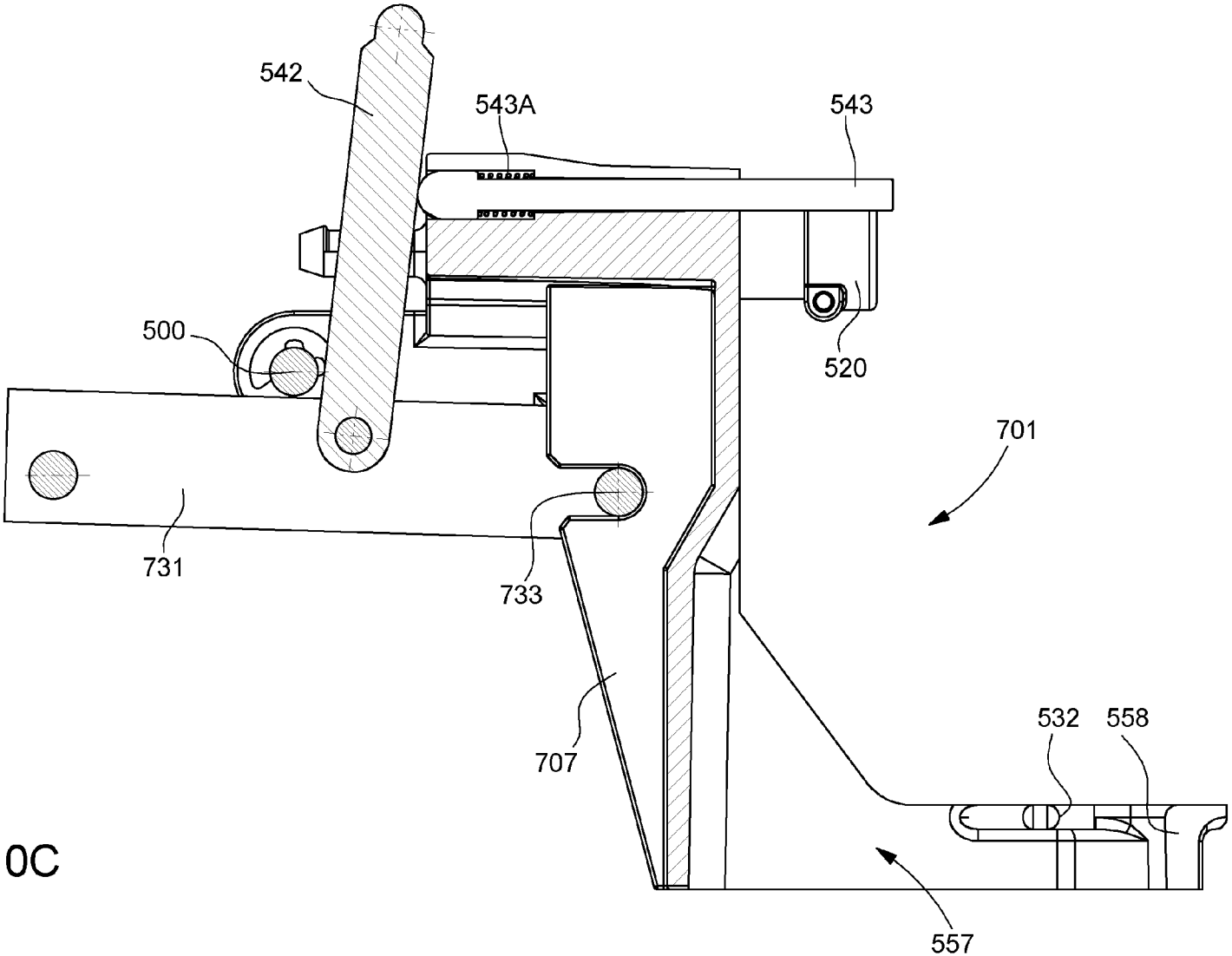
FIG. 10C depicts of cross section of the drawer shown in FIG. 10A through the means for activating the venting means of the dispensing device.
Figure 10D:
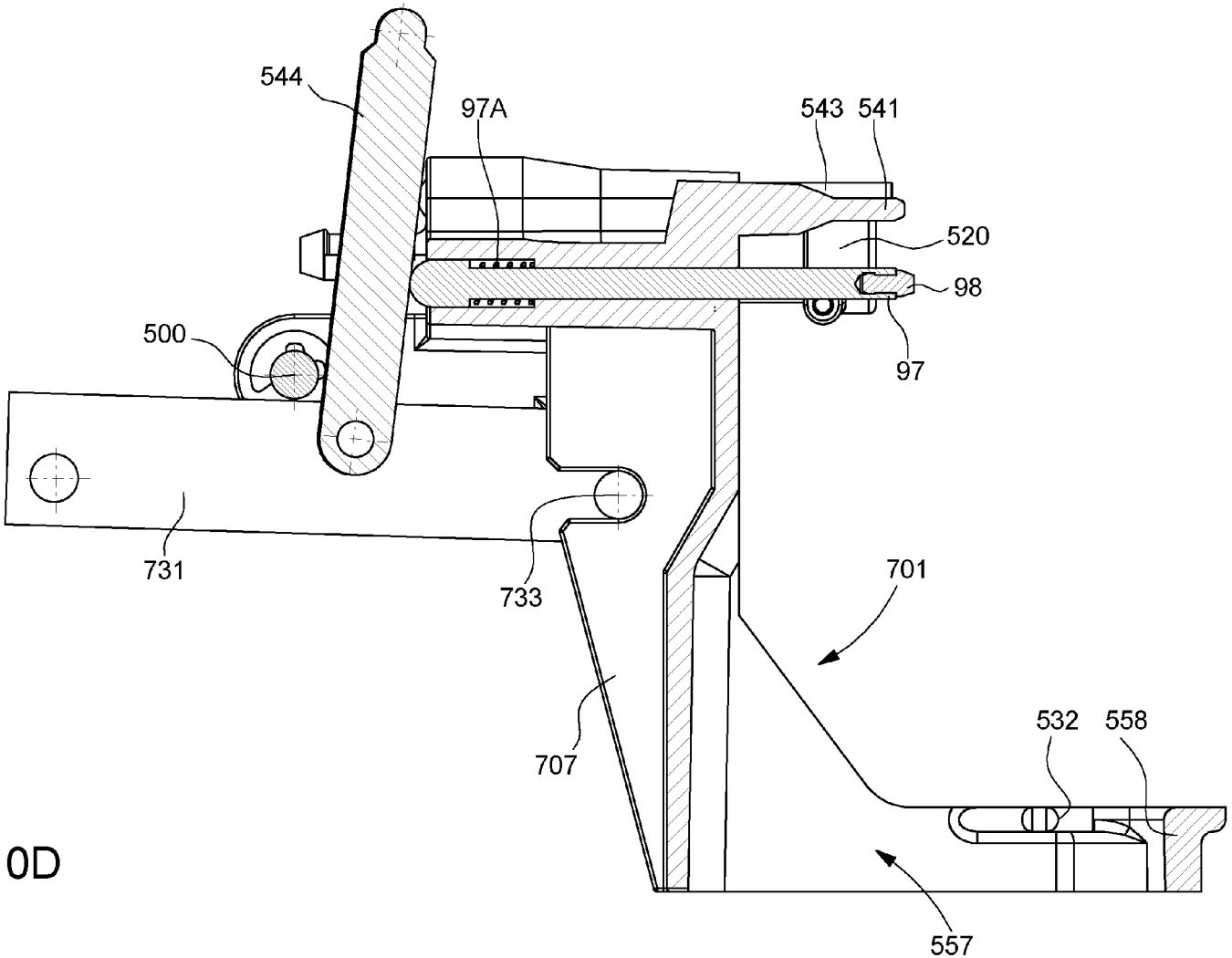
FIG. 10D depicts of cross section of the drawer shown in FIG. 10A through the means for activating the foam/no foam activating means of the dispensing device.
Figure 10E:
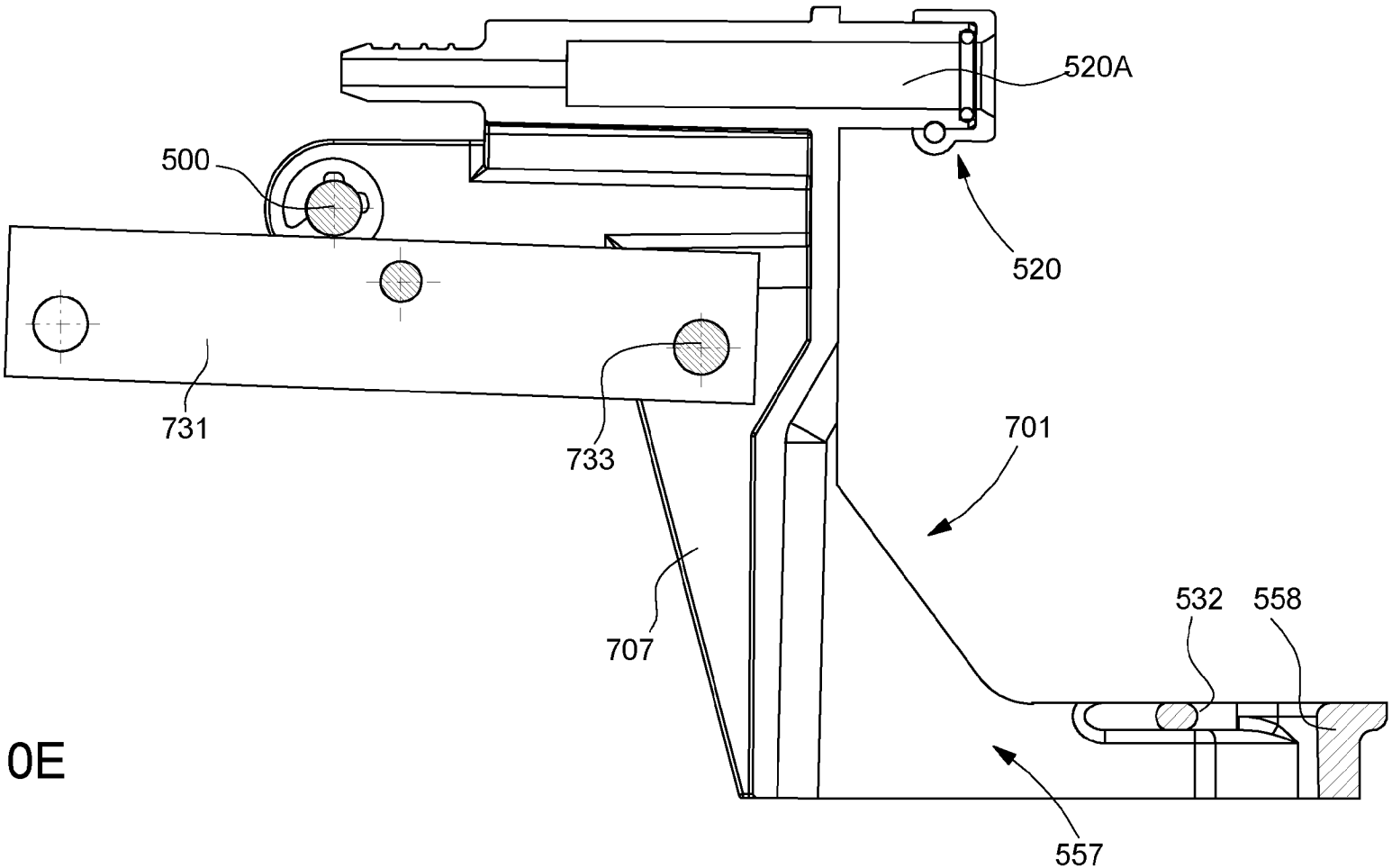
FIG. 10E depicts of cross section of the drawer shown in FIG. 10A through the diluent coupling means.
Figure 11:
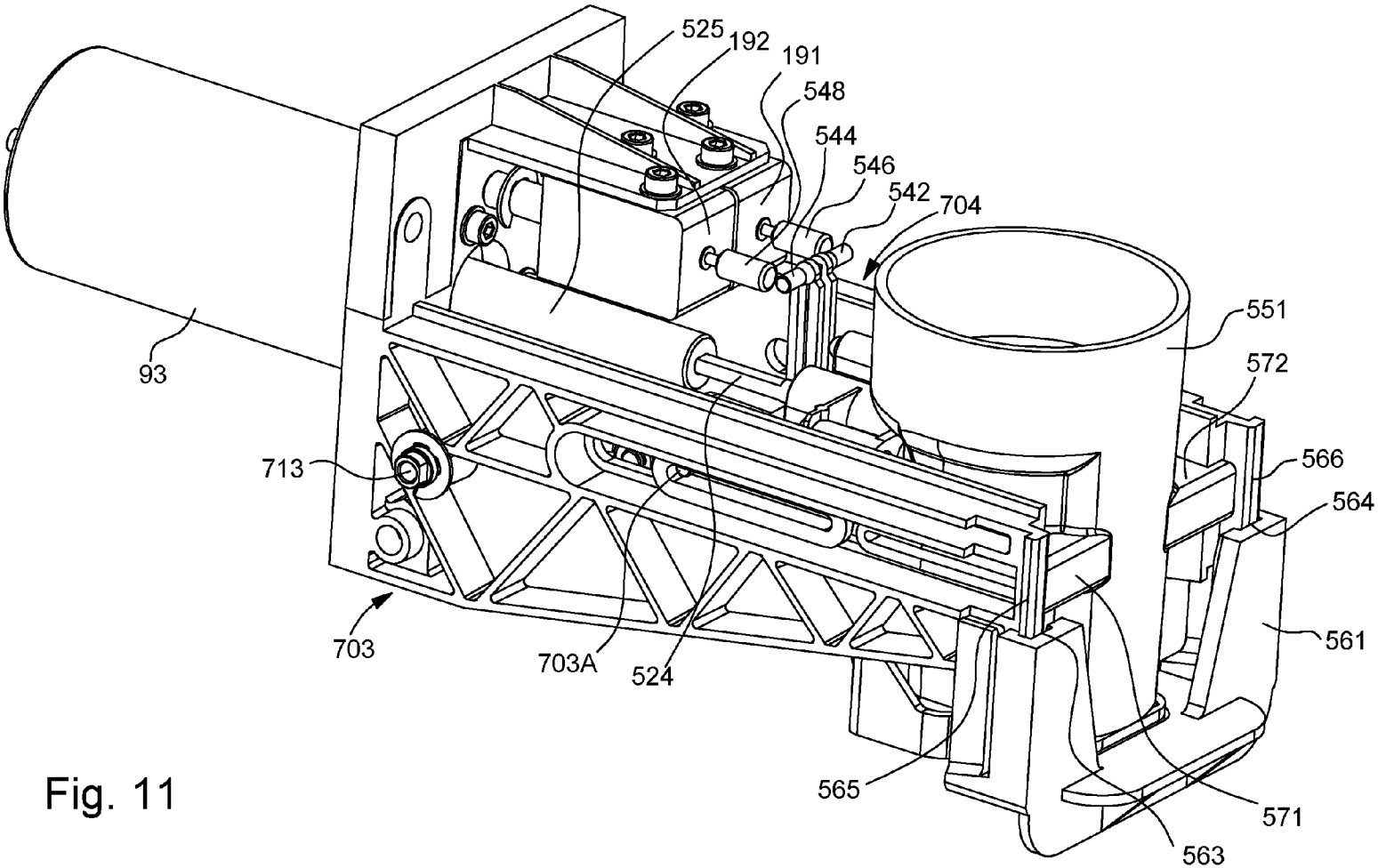
FIG. 11 is a front perspective view of the base station of FIG. 10, with the cap holder shown in position but with the front guard portion in a position which allows the removal of the cap holder.
Figure 12:
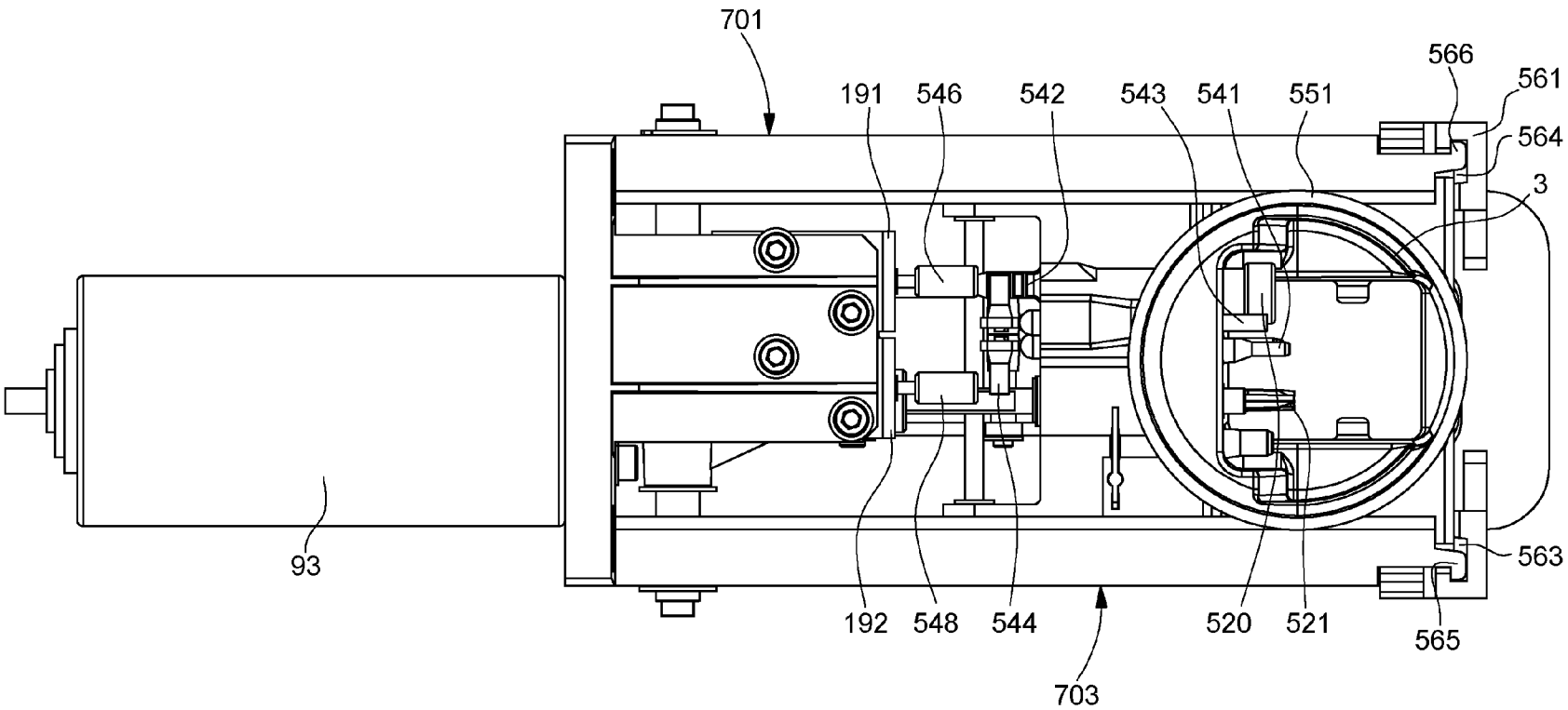
FIG. 12 is a plan view of the base station of FIG. 10.
Figure 13:
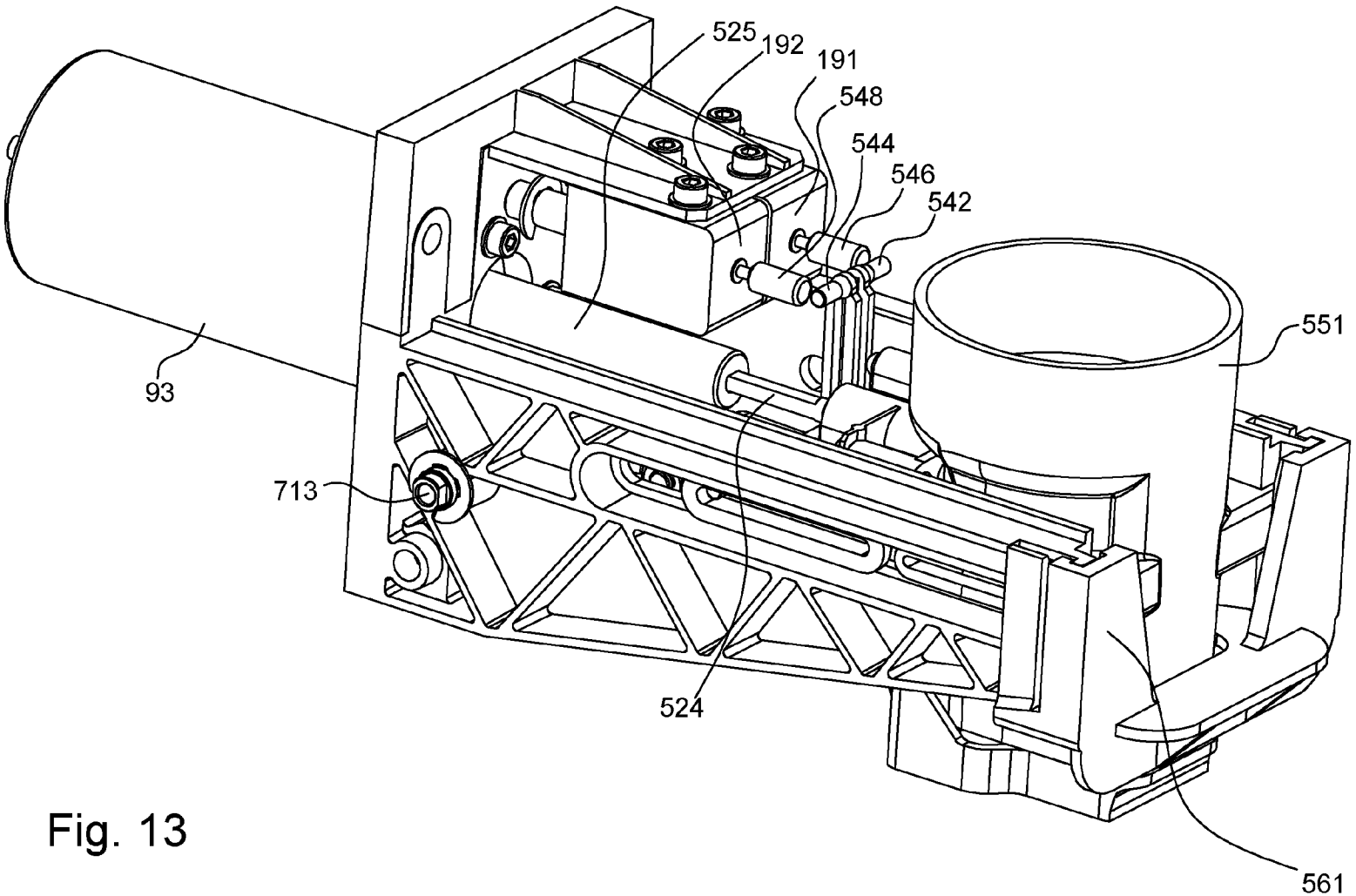
FIG. 13 depicts a side perspective view of the base station of FIG. 10 with the front guard portion raised to allow coupling of a cap device with the coupling means of the base station.
Figure 19:
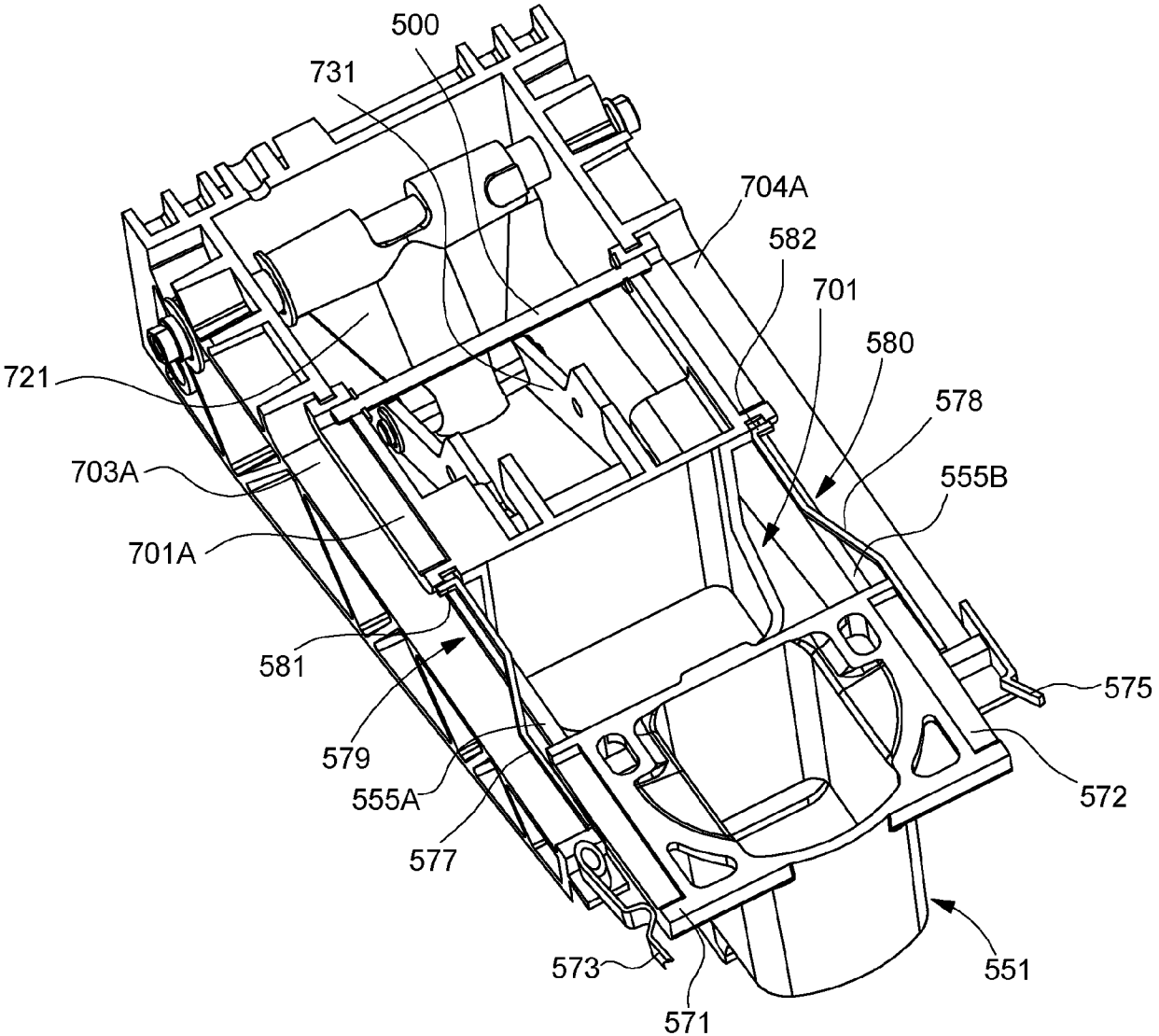
FIGS. 19 to 21 show perspective partial views from above of an alternative embodiment of the base station at various stages of the insertion of cap holder onto the base station.

The base station may comprise guide rails 555A, 555B as seen in FIGS. 10 and 19, on which the holder 551. can be slide into position via flanges 571, 572 provided on two opposite sides. The holder is shaped generally to receive the dispensing device 3. The holder 551 may have separate apertures for the pump coupling means 521 for the cutter driving means 541 and for the diluent coupling means 520, or may be formed with an opening large enough to accommodate the pump coupling means 521, the diluent supply and its coupling means 520, the air supply control means 97, if present, the driving means 541 for driving the push pin 103 which actuates the cutter and the coupling means 543 for driving the piston 205 which effects venting, if used.

The dispensing device 3 is formed with the outer cover 301 on the opposite side from the coupling means 650, 650A and push pin 103, diluent intake 71 and air intake 74, so that the dispensing device is placed in the holder 551 with its outer cover at the side furthest from the drawer 701. The drawer 701 carries a stirrup-shaped opening and closing device 557 for the cover 301. The holder 551 has cutaway portions to allow contact between the stirrup 557 and the outer cover 301. The stirrup 557 carries two bosses 531, 532, one on each side of the stirrup, which engage with the side pieces 323, 324 of the movable flap 305 of the outer cover 301 and open the cover as the drawer 701 moves towards the holder 551. The end portion of stirrup 557 forms a closing bar 558 so that the bottom of the cover 301 is constrained between the bosses 531, 532 and the closing bar 558 of the stirrup. When the drawer 701 is moved away from the holder 551, the closing bar 558 of the stirrup pushes against the outer cover 301 to close the flap 305.

The base station 5 of the embodiment shown in particular in FIGS. 10 to 13 has a front guard portion 561 which is movable vertically. The guard 561 is formed with grooves 563, 564 which move along posts 565, 566 at the front end of the base station. The guard portion 561 is lowered to allow the holder 551 to be inserted on the guide rails 555A and 555B of the base station and can then be raised to secure the holder in the base station.

The mechanism for moving the drawer 701 is an extendable joint mechanism 711 comprising two rigid limbs 721, 731 linked by a knee joint 740. The limb 721 is mounted on a drive shaft 713 perpendicular to the direction of movement of the drawer 701. The drive shaft 713 has drive means (not shown) separate from the drive means 93 and which can be manual or mechanical. For example the drive means for drive shaft can comprise a cylinder (not shown) acting on a drive lever 713A rotatably connected to drive shaft 713. In the example shown in FIG. 14A, drive shaft 713 comprises two self tapping screws 7136, 713C screwed into the rigid limb 721. Rigid limb 721 is preferably made of plastic material. The limb 721 has a triangular shape one tip of which comprising a cylinder 721A surrounding a spring 723 acting against the knee joint 740. The limb 731 extends between knee joint 740 and a shaft 733 mounted in bearings in a support member 707 of the drawer 701.

Movement of the coupling means 543, which comprise here a piston 543 that is mounted as to slide in the drawer 701, for driving the piston 209 which effects venting of the container can also be performed by the lever 542 capable of engaging with a piston 546 driven by a solenoid actuator 191. Similarly movement of the pin 97 for controlling the supply of air to the air duct 73 via hole 74 to achieve foaming or no foaming is performed by a lever 544 capable of engaging with a piston 548 driven by a solenoid actuator 192. (Lever 542 is not seen in FIGS. 14 to 17 as it is hidden by lever 544.) The levers 542 and 544 are mounted on the limb 731 of the joint mechanism 711. The piston 543 and the pin 97 are both biased by a return means, here helical springs 543A and 97A towards the levers 542 and 544.

Figure 14:
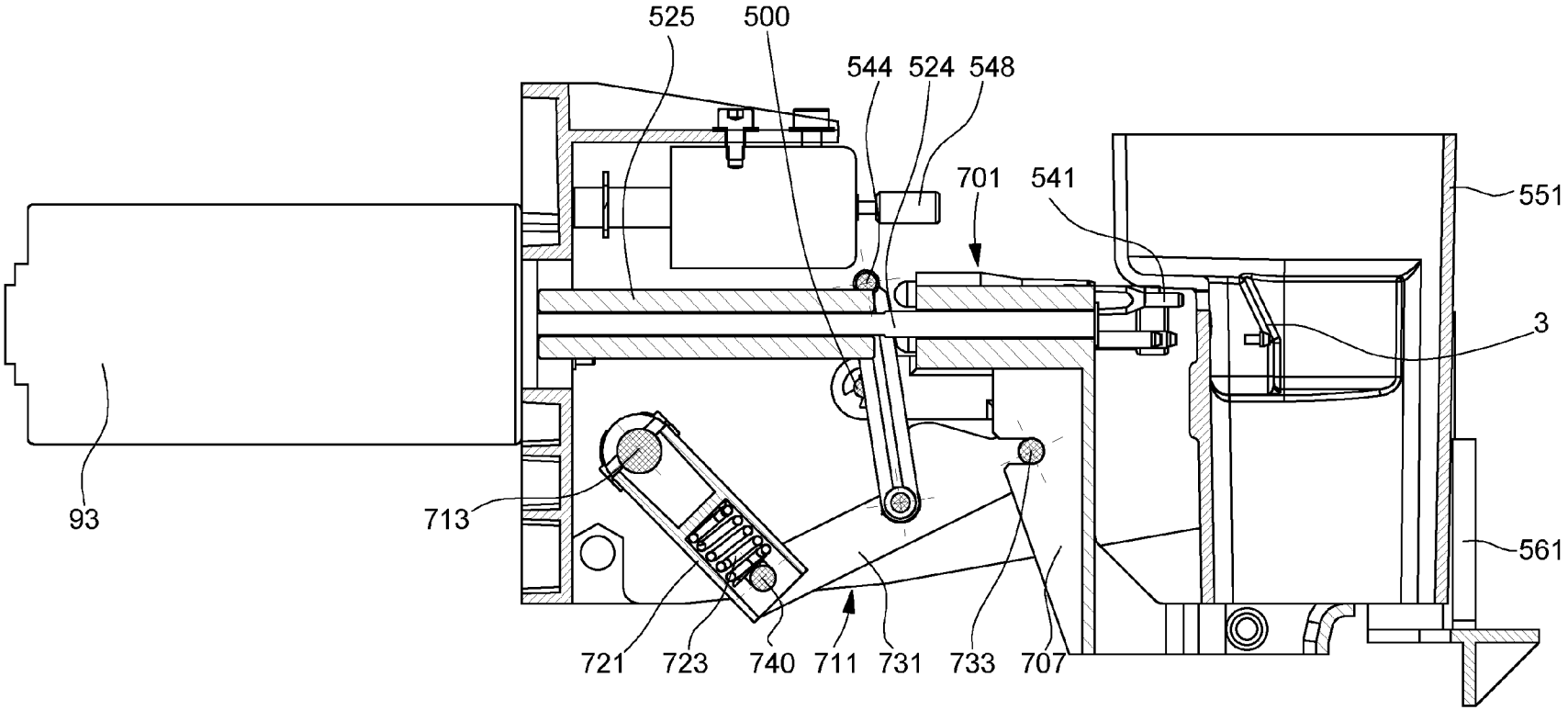
FIG. 14 depicts a sectional view of the base station of FIG. 10 with the drawer in a withdrawn position.
Figure 14A:
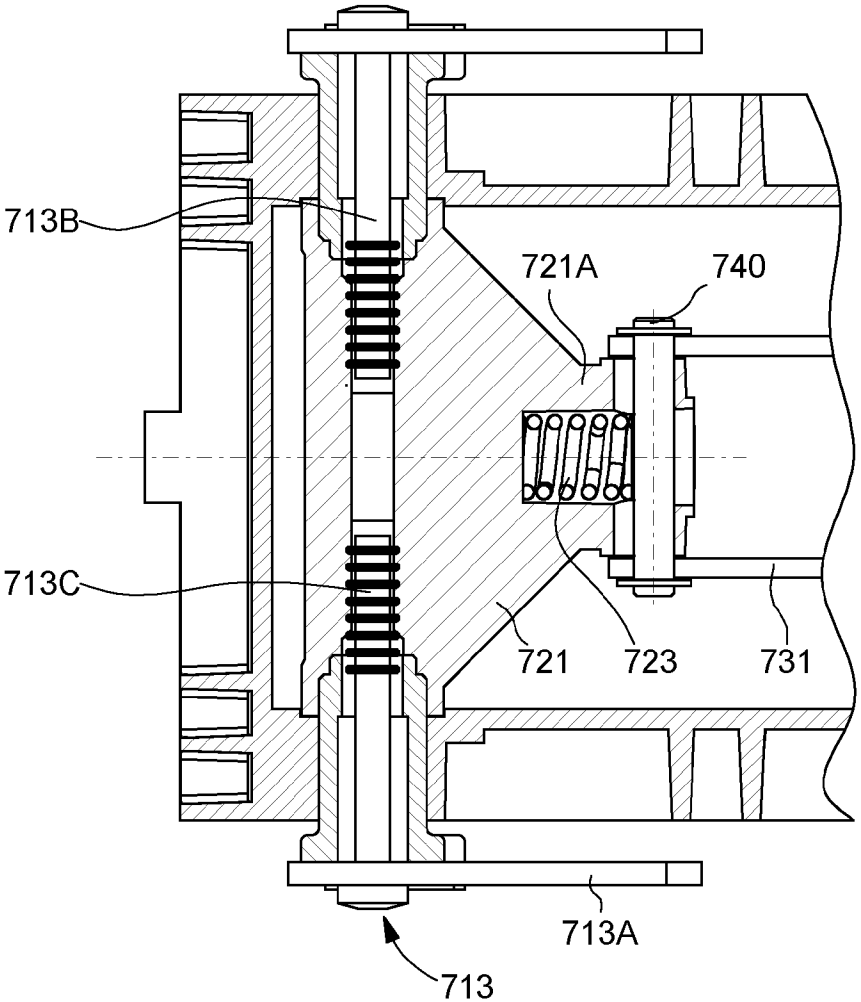
FIG. 14A depicts a cross section through the knee joint of the drawer of the base station of FIG. 10.

When a package comprising a dispensing device 3 attached to a container 4 is inserted in the cap holder 551, the drawer 701 is in the position shown in FIG. 14, this being the rest position where the spring 723 is not compressed.

Figure 15:
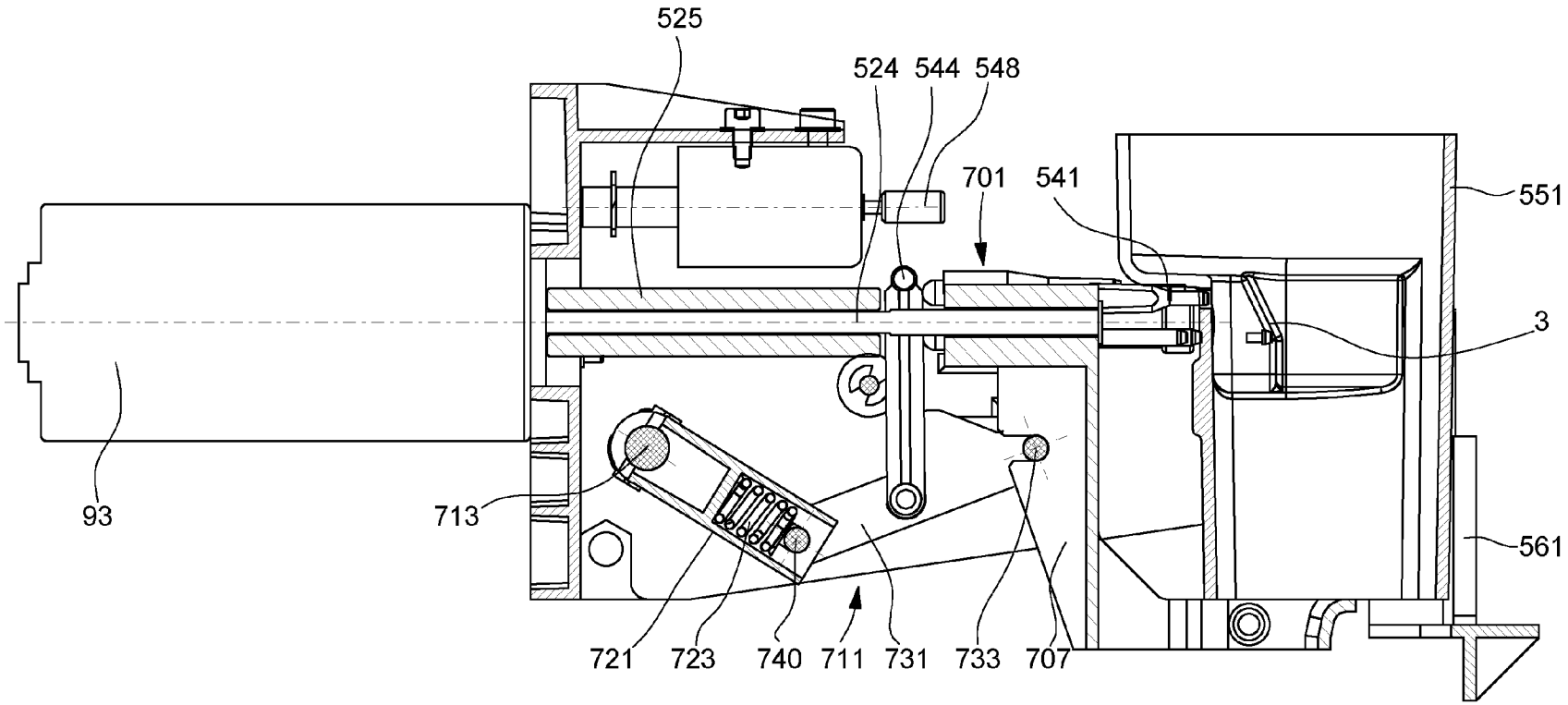
FIG. 15 depicts a sectional view of the base station of FIG. 14 with the drawer extended so that the coupling means penetrate the cap holder.

When the machine is activated to dispense a drink, a torque is applied to the shaft 713 (manually or mechanically) to rotate the limb 721 towards the position shown in FIG. 15. Such movement extends the knee joint 740 and pushes the limb 731, and thus the drawer support 707 and drawer 701, towards the cap holder 551. The movement of the limb 731 also starts to raise the levers 542 and 544.

It will be noted that the levers 542 and 544 are guided during their upward movement between a bar 500 mounted on base station 5 and extending transversally to the movement of the drawer 701 and the ends of coupling means 543 and pin 97.

Figure 16:
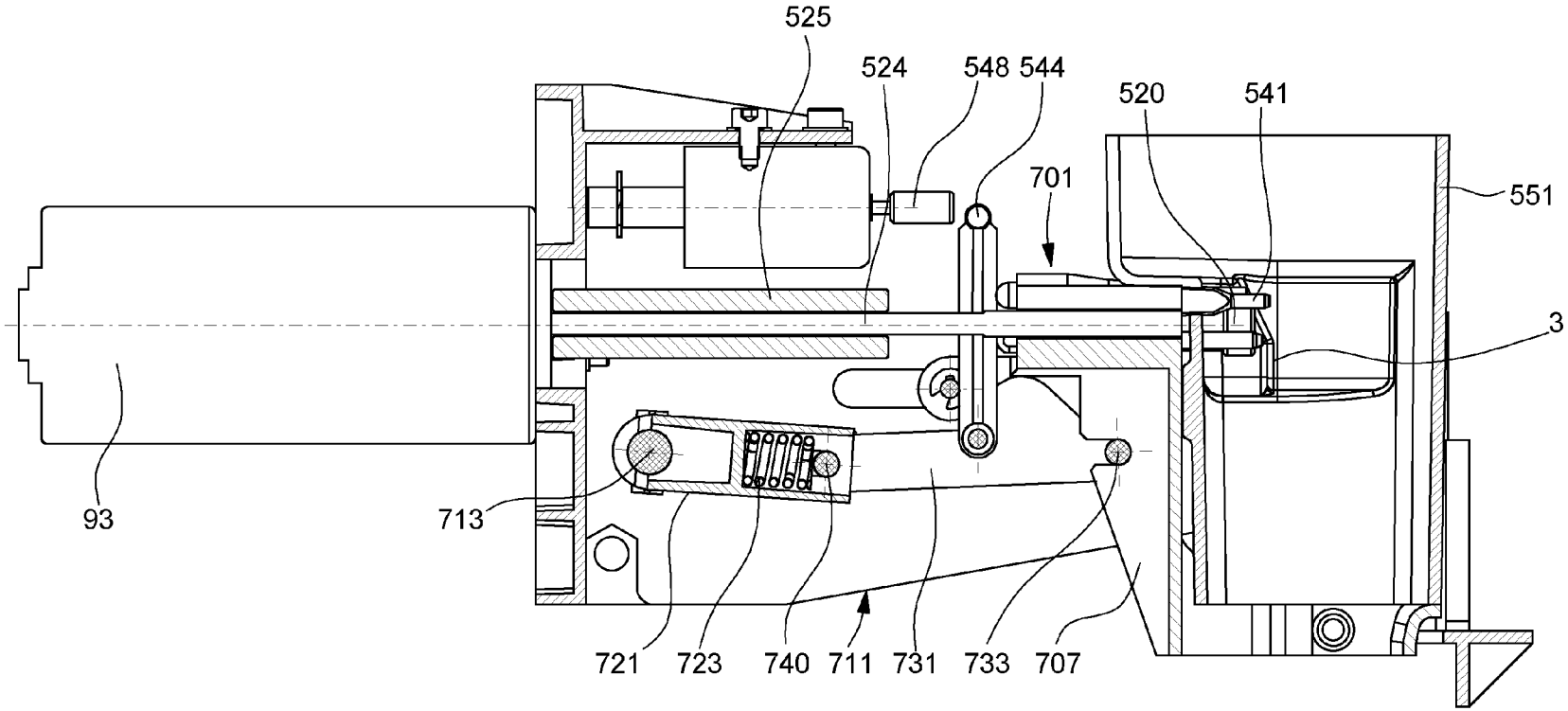
FIG. 16 depicts a sectional view of the base station of FIG. 14 with the drawer fully extended so that the coupling means engage with the coupling means of the dispensing device.
Figure 17:
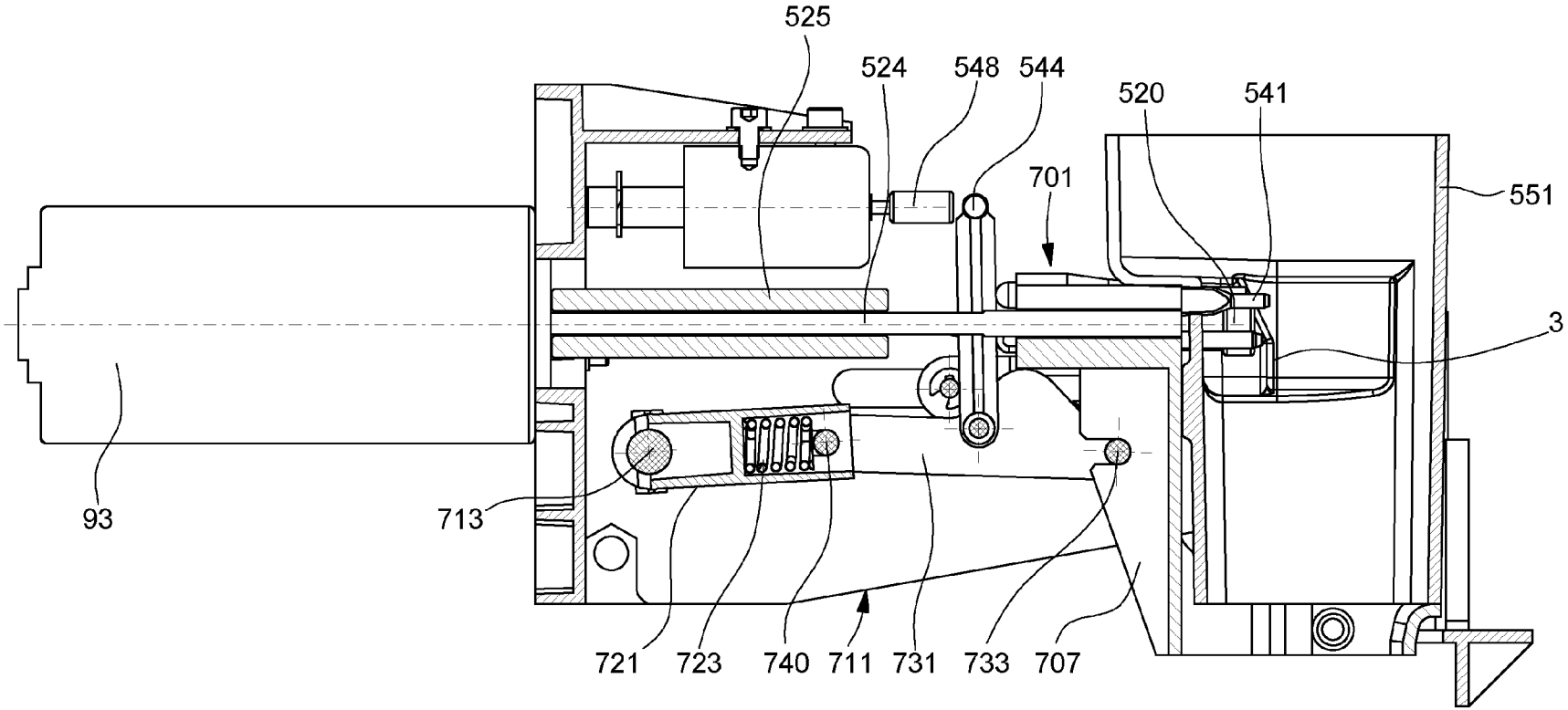
FIG. 17 depicts a sectional view of the base station of FIG. 14 following in sequence the position shown in FIG. 16, with the coupling means engaged with the coupling means of the dispensing device.
Figure 18:
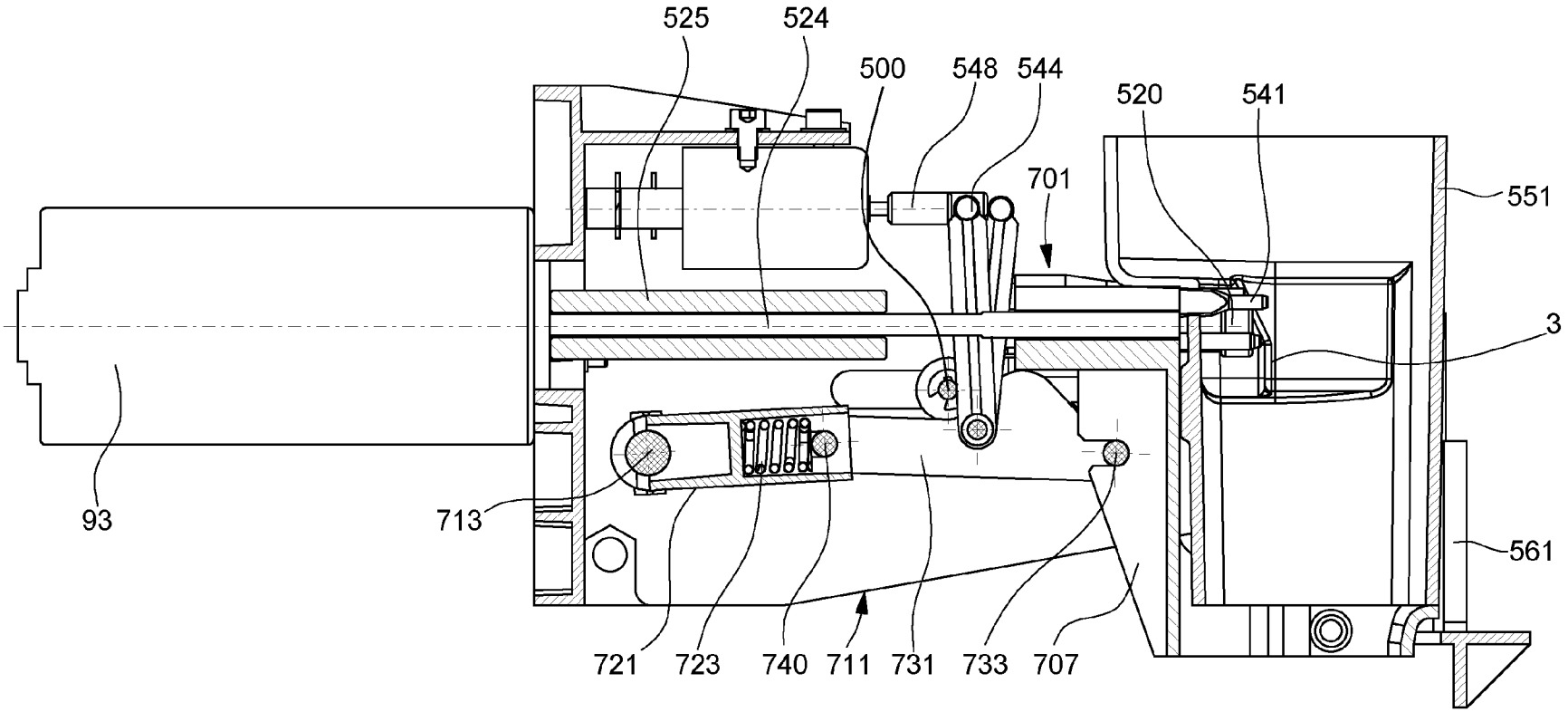
FIG. 18 depicts a sectional view of the base station of FIG. 14 following in sequence the position shown in FIG. 17, with a lever operating the venting valve.

Continuing movement further extend the knee joint 740 and moves the drawer 701 to a position in which the pump coupling means 521 and the diluent coupling means 520 extend through the holder 551, as shown in FIG. 16. Continuing movement and further extension of the knee joint 740 moves the drawer 701 to a position in which the pump coupling means 521 and the diluent coupling means 520 engage with the coupling means 650, 650A and diluent intake 71 of the device 3, as shown in FIG. 17. In this position the coupling means 520 engages with the push pin 103 and the foam/no foam coupling means 97 engages with the air inlet 74. In this position venting 543 is positioned facing venting piston pin 209 for activation upon demand. Positioning pin 705 is fitted in corresponding positioning hole 705A (FIG. 3) of the device 3. Slight further movement of the joint mechanism 711 to its furthest extent raises the levers 542 and 544 to the position shown in FIG. 18, where they can be operated by the pistons 546 and 548 respectively. The machine is now configured to dispense a drink. During the forward movement of the drawer 701, the pin 541 comes into contact with the push pin 103 and pushes it forward so as to operate the cutter 101 to cut protective foil 41 open. The machine and the packaging are then ready to operate and dispense a drink. The drive shaft 524 is then operated to drive the pump 6 through coupling means 521 and 650, 650A to dispense a measured amount of liquid from the container 4 through duct 69. Simultaneously or subsequently diluent is supplied through coupling means 520 and intake 71, and the air intake closing means 97, 98 can be activated if foaming of the drink is not required. The diluted drink, optionally foamed, is dispensed through outlet 85. The push pin 543 may then be actuated to allow venting of the container 4.

After operation of the above sequence of activities to dispense a drink, the drawer remains in place until the container needs to be removed, e.g. when it is empty, then the user can command the disengagement of the drawer from the caps upon which the joint mechanism is returned to its rest position shown in FIG. 14 to retract the drawer 701.

The metering and mixing device or the container may also comprise a code that can be read by a reader associated with the base station 5. The code comprises information referring to the identity and/or the nature of the product and/or to parameters concerned with the activating of the diluent supply and/or liquid pump drive means. The code may, for example, be used to manage the flow rate of the liquid pump and/or of the diluent pump, contained in the base station, so as to control the liquid:diluent ratio. The code may also control the opening or closing of the air intake in order to obtain a frothy or non-frothy drink.

Figure 20:
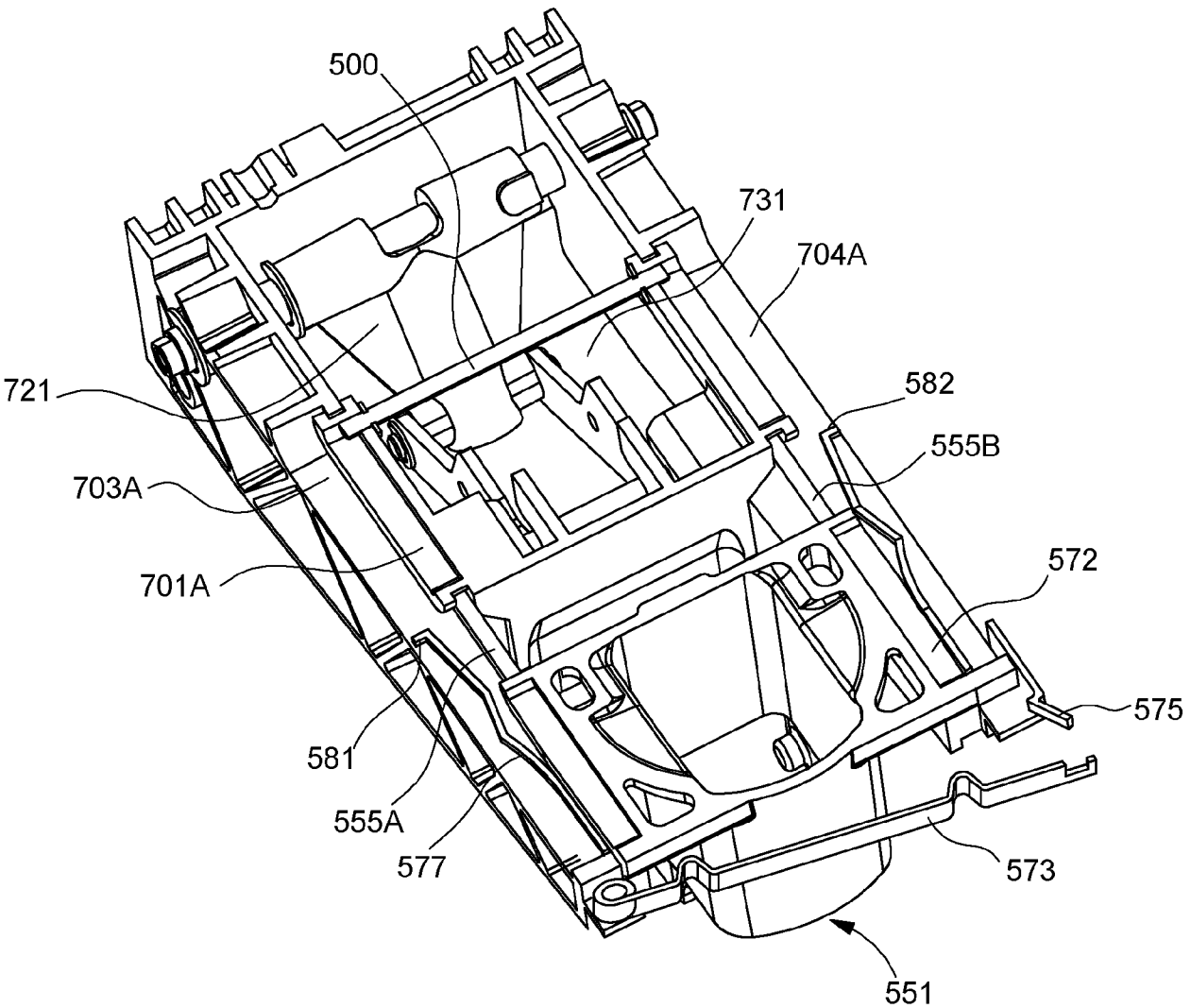
Figure 21:
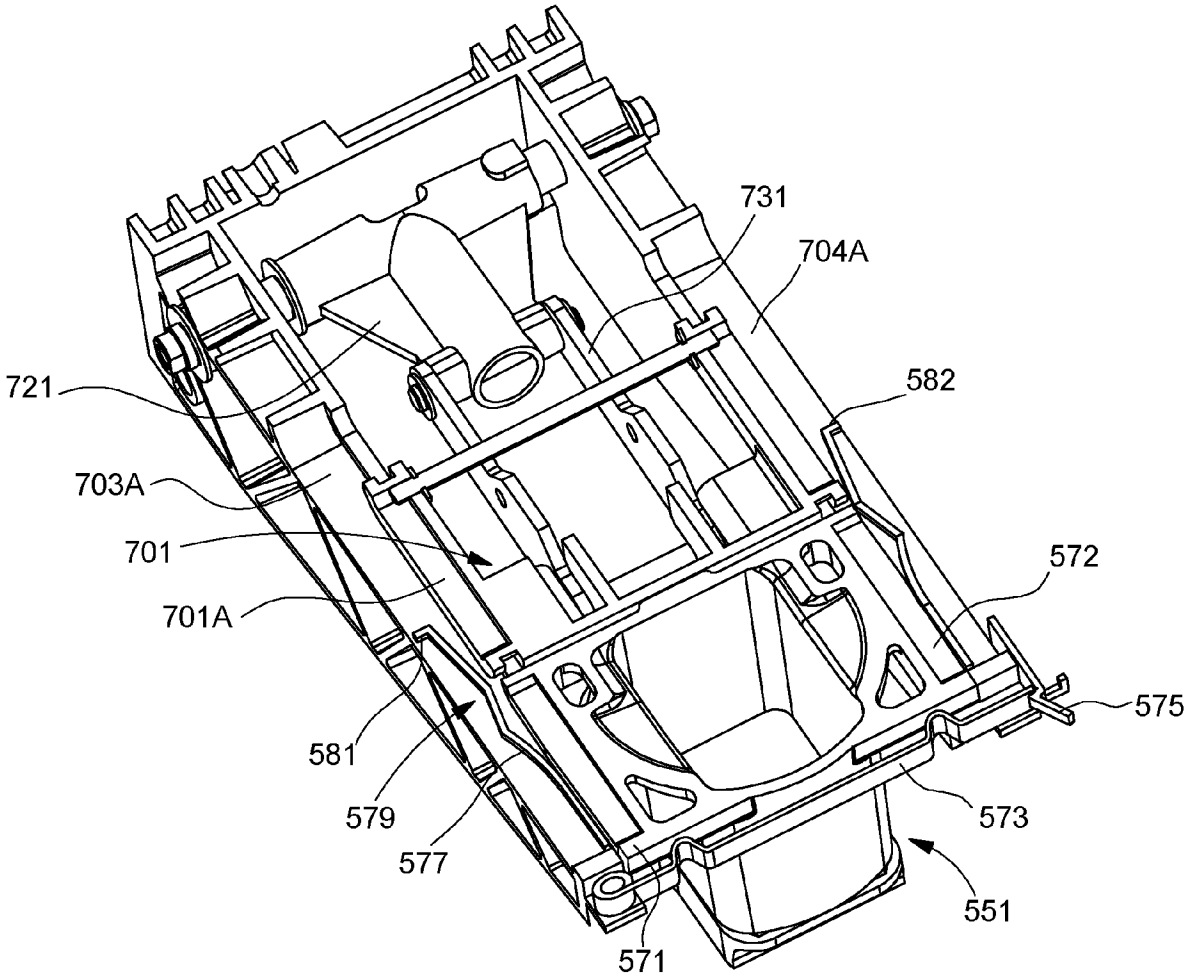

FIGS. 19 to 21 show an alternative embodiment of the invention, in which those elements that are identical to those already described are designated by the same reference numerals. This embodiment differs from that which was described in connection with FIGS. 1 to 18 only in that it further comprises means for preventing the forward movement of drawer 701 unless cap holder 551 is properly in place in the docking station of base station. FIGS. 19 to 21 show the docking station at various stages of the insertion of cap holder 551 onto the docking station.

In the embodiment of FIGS. 19 to 21, the cap holder 551 is formed with flanges 571, 572 which rest on the guide rails 555A, 555B. The holder 551 can be secured in position by door 573 hinged onto the end a support member 703 and which is fastened by fastener 575. In example shown, the fastener 575 comprises a bent elastic leaf secured by one end to the support member opposite to that carrying the door hinge, which latches onto a cut out portion of the door 573 Springs 577, 578 are mounted within the rails 555A, 555B to press inwardly against the flanges 571, 572 of the cap holder 551 and against the drawer 701. In particular the springs 577, 578 are bent so as to have inwardly facing angles 579, 580 pressing against the end of the flanges adjacent to the drawer 701. The ends of the springs are bent to form buffer portions 581, 582.

This arrangement helps in holding the base station 5 in a safe configuration for maintenance and in preventing restart of the machine before the holder 551 is correctly positioned as the buffer portions 581, 582 block the movement of the drawer 701 when the cap holder is not in place in the docking station and the drawer is retracted (FIG. 19).

When maintenance, for example of any of the various coupling means carried by the drawer 701, is required, the fastener 575 is unlatched and the door is opened. The holder 551 can then be removed by sliding the flanges along rails 555A, 555A. The springs 577, 578 remain in the position shown in FIG. 19 as the holder 551 is removed. When the drawer has been retracted, the springs 577, 578 spring inwards so that the buffer portions 581, 582 block movement of the drawer 701. Maintenance can be carried out in this position.

FIG. 20 shows the cap holder 551 during insertion onto the docking station. When maintenance is completed, the holder 551 is inserted along the rails 555A, 555B. As the front corners of the flanges 571, 572 move towards the drawer 701, they engage the angles 579, 580 of the springs, pushing the springs outwards so that the buffer portions 581, 582 no longer block the drawer 701. The door 573 is then shut and fastened by latch 575 so that the holder 551 is in its operating position. Movement of the drawer 701 can then be performed as described with relation to FIGS. 14 to 18.

FIG. 21 shows the holder 551 in its operating position. The arrangement of FIG. 21 ensures that the drawer is not operated unless the holder 551 is in its correct position.

Figure 22:
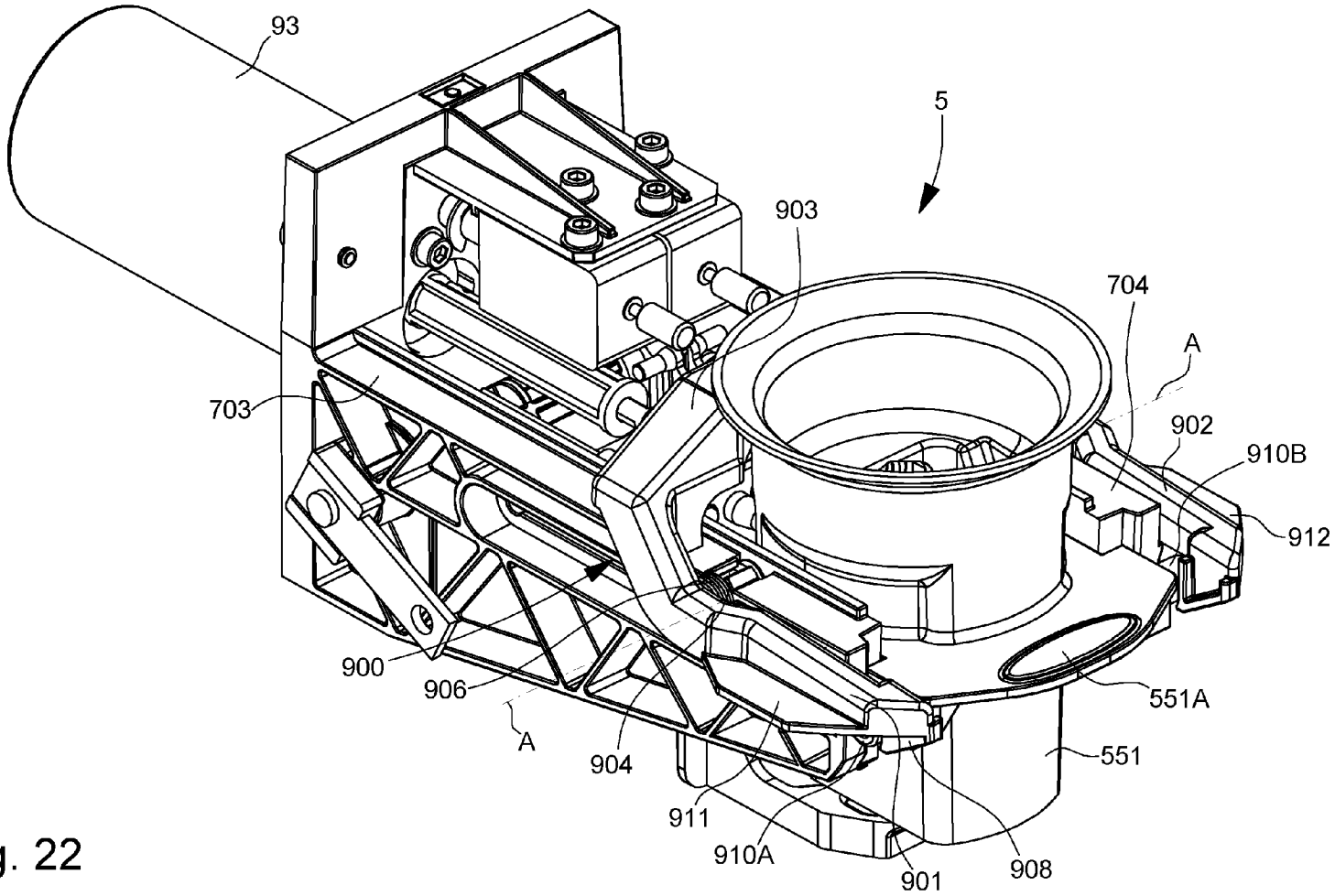
FIGS. 22 and 23 are similar views to FIG. 19 showing alternative means to secure the cap holder in the base station
Figure 23:
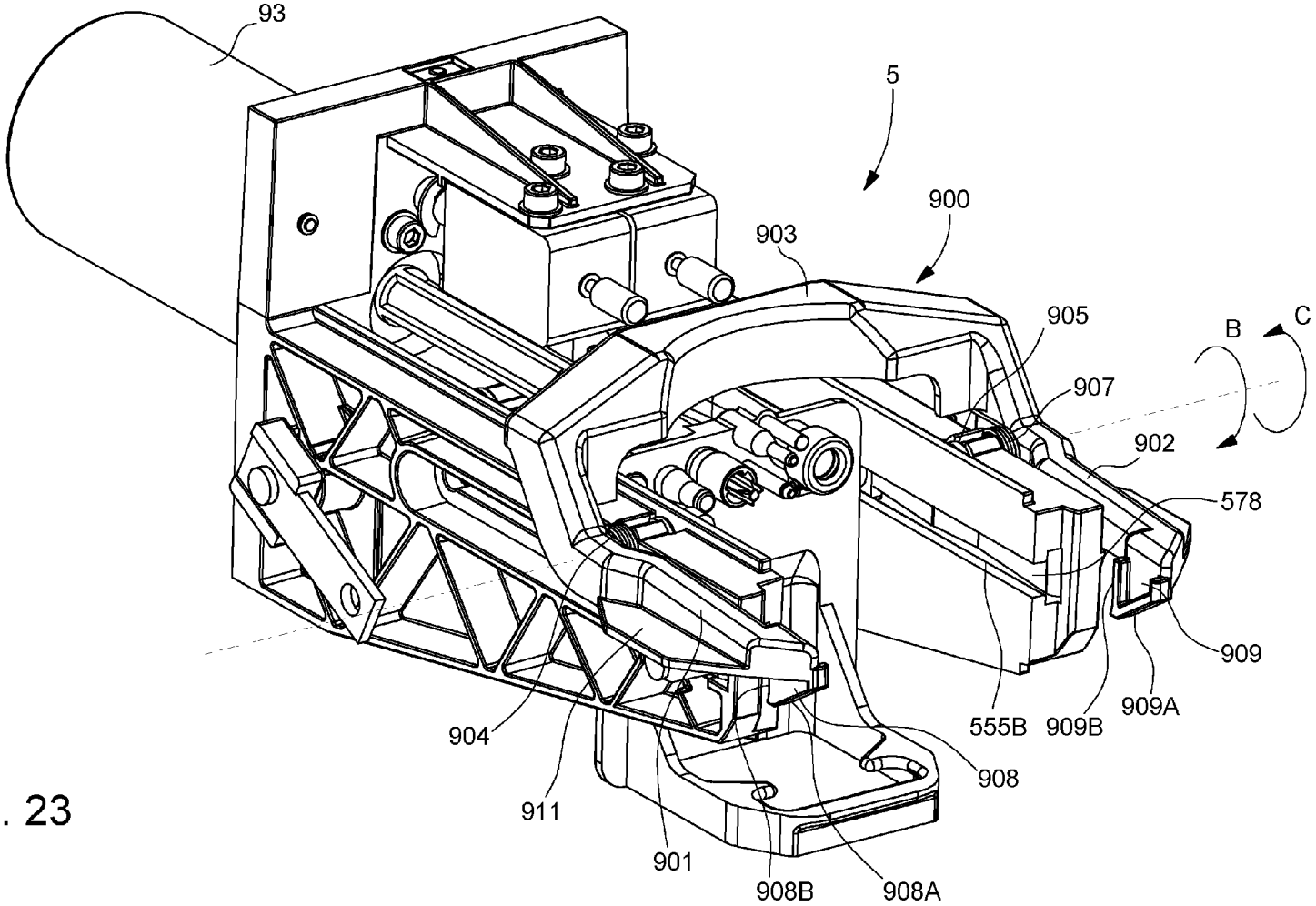

FIGS. 22 and 23 show an alternative embodiment of the invention, in which those elements that are identical to those already described are designated by the same reference numerals. In FIG. 23, the cap holder 551 has been omitted.

In this embodiment only the means to secure the cap holder 551 in the base station are different from those described in connection with FIGS. 10 to 21. In the embodiment shown in FIGS. 22 and 23, the base station 5 comprises a locking member 900 for locking the cap holder 551 onto the base station 5. The locking member 900 is U-shape member comprising two side bars 901, 902 connected together at one of their end by a cross-bar 903. The side bars extend parallel to the support members 703, 704, while the cross-bar 903 extends perpendicularly to the side bars 901, 902. The locking member 900 is mounted so as to pivot onto the base station about an axis A-A. In the example shown, the side bars 901, 902 comprise two pivoting studs 904, 905 facing each other and arranged to protrude from the inside of the side bars 901, 902. A return spring 906, 907 is associated to each of the pivoting studs 904, 905 to bias the locking member into a rest position in which the free ends of the side bars 901, 902 rest onto a surface of the base station 5. Each of the side bars 901, 902 comprises at its free end a hook 908 909. The hooks 908, 909 are oriented facing the base station and each comprises advantageously a ramp portion 908A. 909A inclined downwards in the direction of insertion of the cap holder 551 and which extends by a recess portion 908B, 909B. The cap holder 551 comprises a locking bar 910 protruding on both sides of the cap holder transversally to the insertion direction thereof in the base station 5. The free ends 910A, 910B of the locking bar 910 are intended to engage with the hooks 908, 909 when the holder 551 is inserted along the rails 555A, 555B so as to lock the cap holder securely into place in the base station. As a result of this structure, when cap holder is inserted along rails 555A, 555B, before the cap holder 551 reaches its end position in the base station 5, the ends 910A, 910B of the locking bar 910 engage the ramp portions 908A, 909A respectively and push the locking member 900 upwards against the resilient force of the return springs 906, 907 in the direction of the arrow C until the ends 910A, 910B fall in the recess 908B, 909B thereby causing the locking member 900 to swing back in the direction of arrow B into its rest position where the cap holder is securely into place.

In the embodiment shown the movement of the locking member 900 is controlled manually and to that effect the locking member 900 advantageously comprises one handling tab 911, 912 on each side bar to facilitate the control thereof.

A handling tab 551A for is also advantageously provide onto cap holder 551 to facilitate its insertion in and out of the base station 5. The invention also extends to the field of the preparation of non-food products. For example, the invention may be used in the field of the dispensing of products which come in the form of liquids that can be diluted, such as washing powders, soaps, detergents or other similar products.

The invention claimed is:

1. A device for dispensing a liquid, the device being connectable to a container containing the liquid and detachably connectable to a base station for docking the device and having drive means, the device comprising a liquid duct and a liquid pump actuated by the base station drive means for moving the liquid through the duct, the device comprises a cutter for piercing a tamper resistant foil located across the outlet of the container and means for actuating the cutter are operable from outside the device.

2. The device of claim 1, wherein the cutter comprises a blade and the actuating means comprises a push pin urging the blade through the foil.

3. The device of claim 2, wherein the cutter and actuating means are non-retractable so that when the blade has perforated the foil, the blade continues to protrude through the foil.

4. The device of claim 1, wherein the cutter comprises a blade having a V-shaped cutting edge so as to form a V-shaped perforation in the foil.

5. The device of claim 4, wherein the cutter is substantially planar with a peak portion including the V-shaped cutting edge extending upwards from the planar portion of the blade.

6. The device of claim 2, wherein the cutter is mounted so as to rotate about an axis and comprises a lever portion integral with the blade and on an other side of the axis from the cutting edge so that the push pin can act against the lever portion of the blade by a lever mechanism.

7. The device of claim 2, wherein the cutter is made of a hard plastic material.

8. The device of claim 1, wherein the means for moving liquid through the duct comprises a pump which measures aliquots of the liquid through duct and means for driving the pump are detachably connectable to the drive means of the base station.

9. The device of claim 8, wherein the device has venting means comprising a valve and opening means that is operable after or during the passage of liquid through the duct, the opening means comprising a piston operated by the means arranged on the base station.

10. The device of claim 1, wherein the device comprises a diluent inlet with a diluent duct and a mixing chamber, the diluent duct is positioned with respect to the liquid duct for the diluent stream so as to intersect the liquid stream before or at the mixing chamber, whereby the metered liquid is mixed with a diluent to prepare a food product.

11. The device of claim 1, wherein the means for actuating the cutter are configured to be operable from outside the device by drive means which form part of the base station when the device is connected to base station.

12. A package for dispensing a liquid, comprising: a multi-dose container to form a reserve of liquid and a dispensing device which forms a cap connected to the container, the dispensing device is detachably connectable to a base station for docking the device and having drive means, the device comprising a liquid duct and a liquid pump actuated by the base station drive means moving liquid through the duct, the device comprises a cutter for piercing a tamper resistant foil located across the outlet of the container and means for actuating the cutter are operable from outside the device.

13. The package of claim 12, wherein the cutter and actuating means are non-retractable so that when the cutter has perforated the foil, the cutter continues to protrude through the foil and the cap is connected to the container by a screw thread after the cutter has perforated the foil.

14. An apparatus for dispensing a liquid comprising a package for dispensing a liquid, comprising: a multi-dose container to form a reserve of liquid and a dispensing device which forms a cap connected to the container, the dispensing device is connectable to a container containing the liquid and detachably connectable to a base station for docking the device and having drive means, the device comprising a liquid duct and a liquid pump actuated by the base station drive means moving liquid through the duct, the device comprises a cutter for piercing a tamper resistant foil located across the outlet of the container and means for actuating the cutter are operable from outside the device, the drive means being detachably connected to the means for actuating the cutter of dispensing device.

15. The apparatus of claim 14 wherein the dispensing device comprises a diluent inlet with a diluent duct and a mixing chamber, the diluent duct is positioned with respect to the liquid duct for the diluent stream so as to intersect the liquid stream before or at the mixing chamber, whereby the metered liquid is mixed with a diluent to prepare a food product, the base station has a diluent supply and the apparatus comprises diluent coupling means detachably connecting the diluent supply to the diluent inlet of the dispensing device.

16. A device for dispensing a liquid, the device being connectable to a container containing the liquid and detachably connectable to a base station for docking the device and having drive means, the device comprising:

a liquid duct;

a liquid pump actuated by the base station drive means for moving liquid through the duct;

a cutter for piercing a tamper resistant foil located across the outlet of the container;

a means for actuating the cutter operable from outside the device; and two half-shells assembled along a parting line, one half-shell comprising a recess for accommodating the cutter blade in a position, the one half-shell not piercing the foil, and the other half-shell comprising the means for actuating the cutter.

17. The device of claim 16, wherein a flat portion of the cutter blade includes outwardly projecting journals and the recess includes laterally extending recesses for receiving bearing members accommodating the journals, the journals defining an axis about which the cutter blade can rotate.

18. A device for dispensing a liquid, the device being connectable to a container containing the liquid and detachably connectable to a base station for docking the device and having drive means, the device comprising:

a liquid duct;

a liquid pump actuated by the base station drive means for moving the liquid through the duct; and a cutter for piercing a tamper resistant foil located across the outlet of the container and a means for actuating the cutter operable from outside the device, the cutter comprising a blade and the actuating means comprising a push pin urging the blade through the foil.

19. The device of claim 18, wherein the cutter and actuating means are non-retractable so that when the blade has perforated the foil, the blade continues to protrude through the foil.

20. The device of claim 18, wherein the cutter is mounted so as to rotate about an axis and comprises a lever portion integral with the blade and on an other side of the axis from the cutting edge so that the push pin can act against the lever portion of the blade by a lever mechanism.

21. The device of claim 18, wherein the cutter is made of a hard plastic material.

22. A device for dispensing a liquid, the device being connectable to a container containing the liquid and detachably connectable to a base station for docking the device and having drive means, the device comprising:

a liquid duct;

a liquid pump actuated by the base station drive means for moving the liquid through the duct, the means for moving liquid through the duct comprising a pump that measures aliquots of the liquid through the duct, and a means for driving the pump detachably connectable to the base station drive means;

a cutter for piercing a tamper resistant foil located across the outlet of the container and a means for actuating the cutter operable from outside the device;

a venting means comprising a valve; and an opening means that is operable after or during the passage of the liquid through the duct, the opening means comprising a piston operated by the means arranged on the base station.

23. A package for dispensing a liquid, comprising:

a multi-dose container to form a reserve of the liquid; and a dispensing device forming a cap connected to the container, the dispensing device detachably connectable to a base station for docking the device and having drive means, the device comprising a liquid duct and a liquid pump actuated by the base station drive means moving the liquid through the duct, the device comprising a cutter for piercing a tamper resistant foil located across the outlet of the container and a means for actuating the cutter operable from outside the device, the cutter and actuating means being non-retractable so that when the cutter has perforated the foil, the cutter continues to protrude through the foil and the cap is connected to the container by a screw thread after the cutter has perforated the foil.

24. A device for dispensing a liquid, the device being connectable to a container containing the liquid and detachably connectable to a base station for docking the device and having drive means, the device comprising:

a liquid duct and a liquid pump actuated by the base station drive means for moving liquid through the duct;

a cutter for piercing a tamper resistant foil located across the outlet of the container; and a means for actuating the cutter, the means for actuating the cutter configured to be operable from outside the device by drive means which form part of the base station when the device is connected to the base station.

* * * * *